US005761573A

United States Patent [19]

Haneda et al.

[11] Patent Number: 5,761,573

[45] Date of Patent: Jun. 2, 1998

[54] IMAGE FORMING APPARATUS FOR DOUBLE-SIDED IMAGE FORMATION WITH PROPERLY ADJUSTED IMAGE DENSITY OR COLOR TONE FOR EACH SIDE

[75] Inventors: Satoshi Haneda; Kunio Shigeta; Yotaro Sato; Masakazu Fukuchi; Akitoshi Matsubara; Tadayoshi Ikeda, all of Hachioji, Japan

[73] Assignee: Konica Corporation, Tokyo, Japan

[21] Appl. No.: 821,878

[22] Filed: Mar. 21, 1997

[30] Foreign Application Priority Data

Mar. 26, 1996 [JP] Japan ..... 8-070322

[51] Int. Cl.[6] ..... G03G 15/16

[52] U.S. Cl. ..... 399/66; 399/309

[58] Field of Search ..... 399/297, 66, 298, 399/300, 302, 303, 308, 309, 312

*Primary Examiner*—S. Lee

*Attorney, Agent, or Firm*—Frishauf, Holtz, Goodman, Langer & Chick

[57] ABSTRACT

In an image forming apparatus provided with a photoreceptor on which a obverse toner image is formed, a toner image receiving body on which a reverse toner image is transferred from the photoreceptor, and transfer devices to transfer the obverse image onto one side of a sheet and to transfer the reverse image onto the other side of the sheet. An image forming condition for the reverse image is changed to be different from that for the obverse image.

19 Claims, 14 Drawing Sheets

IMAGE FORMING APPARATUS FOR DOUBLE-SIDED IMAGE FORMATION WITH PROPERLY ADJUSTED IMAGE DENSITY OR COLOR TONE FOR EACH SIDE

BACKGROUND OF THE INVENTION

The present invention relates to an electrophotographic type image forming apparatus such as a copier, a printer, a facsimile machine, or a similar apparatus, in which charging means, image exposure means, and developing means are arranged around an image carrier, and a toner image formed on the image carrier is transferred and fixed onto a transfer material.

Conventionally, in double-sided copying operations, the following method is adopted: an image, formed on an image carrier, is transferred onto and fixed on one side of a transfer material; the transfer material is temporarily accommodated in a double-surface reversal sheet feeding device; the transfer material is sent from the double-surface reversal sheet feeding device in synchronization with an image, formed again on the image carrier; and another image is transferred onto and fixed on the other side of the transfer material.

As described above, in this double-sided copying apparatus, the transfer material is conveyed in such a manner that it is sent to the double-surface reversal sheet feeding device, or it passes through a fixing device two times. Accordingly, conveyance reliability of the transfer material is low, and is often the cause of jamming troubles. With respect to this, a method in which toner images are formed on the both surfaces of the transfer material, and then fixed at one time, has been proposed in Japanese Patent Publication Nos. 37538/1974 and 28740/1979, and Japanese Patent Publication Open to Public Inspection Nos. 44457/1989, 214576/1992, etc.

However, in the image formation due to the above proposals, although the conveyance property of the transfer material is increased, image density of the reverse image is decreased because, in the reverse image formation, transfer is carried out two times from the image carrier to the toner image receiving body, and from the toner image receiving body to the transfer material, as compared to the obverse image formation in which transfer is carried out only one time from the image carrier to the transfer material. This results from the fact that an adhered amount of toner is decreased by approximately 10%, due to an approximately 90% transfer ratio during transfer. Further, due to two-time transfer of the toner image, the toner image scatters (dots are spread and generally, g is increased), and the gradation property changes. Still further, compared to a monochromatic image, new problems of image tone are caused in a color image. Problems of the color toner image are shown in FIG. 16. As shown in FIG. 16, the order of superimposition of color toners is reversed on the obverse and the reverse of the transfer material. Accordingly, the color of the toner of the toner image formed on the uppermost layer is emphasized, or color tone is different because of the decrease of the adhered amount of toner due to re-transferring, so that acceptable color image formation is not carried out, which are problems.

SUMMARY OF THE INVENTION

An object of the present invention is to solve the above problems and to provide an image forming apparatus in which double-sided image formation is carried out with properly adjusted image density or color tone.

The above object can be attained by an image forming apparatus comprising: a first image carrying means to carry a toner image, formed on its surface by a toner image forming means; a second image carrying means onto which the toner image, carried on the first image carrying means, is collectively transferred, and on the surface of which the transferred toner image is carried again; a first transfer means for transferring the toner image, carried on the first image carrying means, onto one surface of a transfer material; a second transfer means for transferring the toner image, carried on the second image carrying means, onto the other surface of the transfer material; and a fixing means for fixing the toner images, transferred onto the double-side surfaces of the transfer material, wherein, in the toner image formation onto the first image carrying means by the toner image forming means, the image forming conditions are changed in the case of the toner image formation by transferring onto the second image carrying means, and in the case of toner image formation by transferring onto a single-side surface of the transfer material.

DETAILED DESCRIPTION OF THE PREFERRED EMBODIMENT

An example of the present invention will be described below. In this connection, description in the present section is not intended to limit the technological scope of claims, or meanings of terms. Further, conclusive explanations in examples of the present invention below only show a best mode of the example, and does not limit meanings of terms or the scope of technology of the present invention. Still further, in the explanation of examples below, an image which is transferred onto one surface, facing an image carrier, of a transfer material in the transfer area, is called the obverse image; and an image which is transferred onto the other surface is called the reverse image.

EXAMPLE 1

Figure 1:
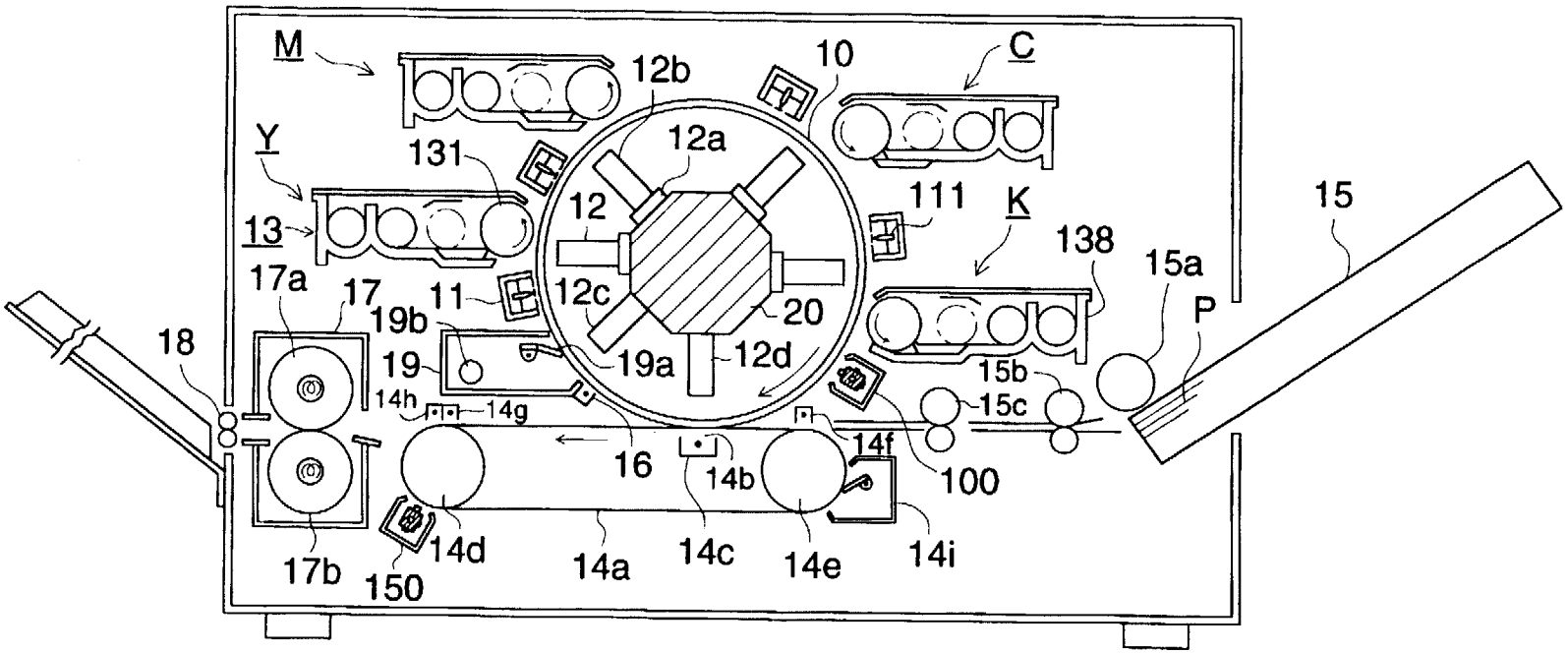
FIG. 1 is a sectional view of the structure of a color printer as a color image forming apparatus showing the first example of the image forming apparatus of the present invention.
Figure 2:
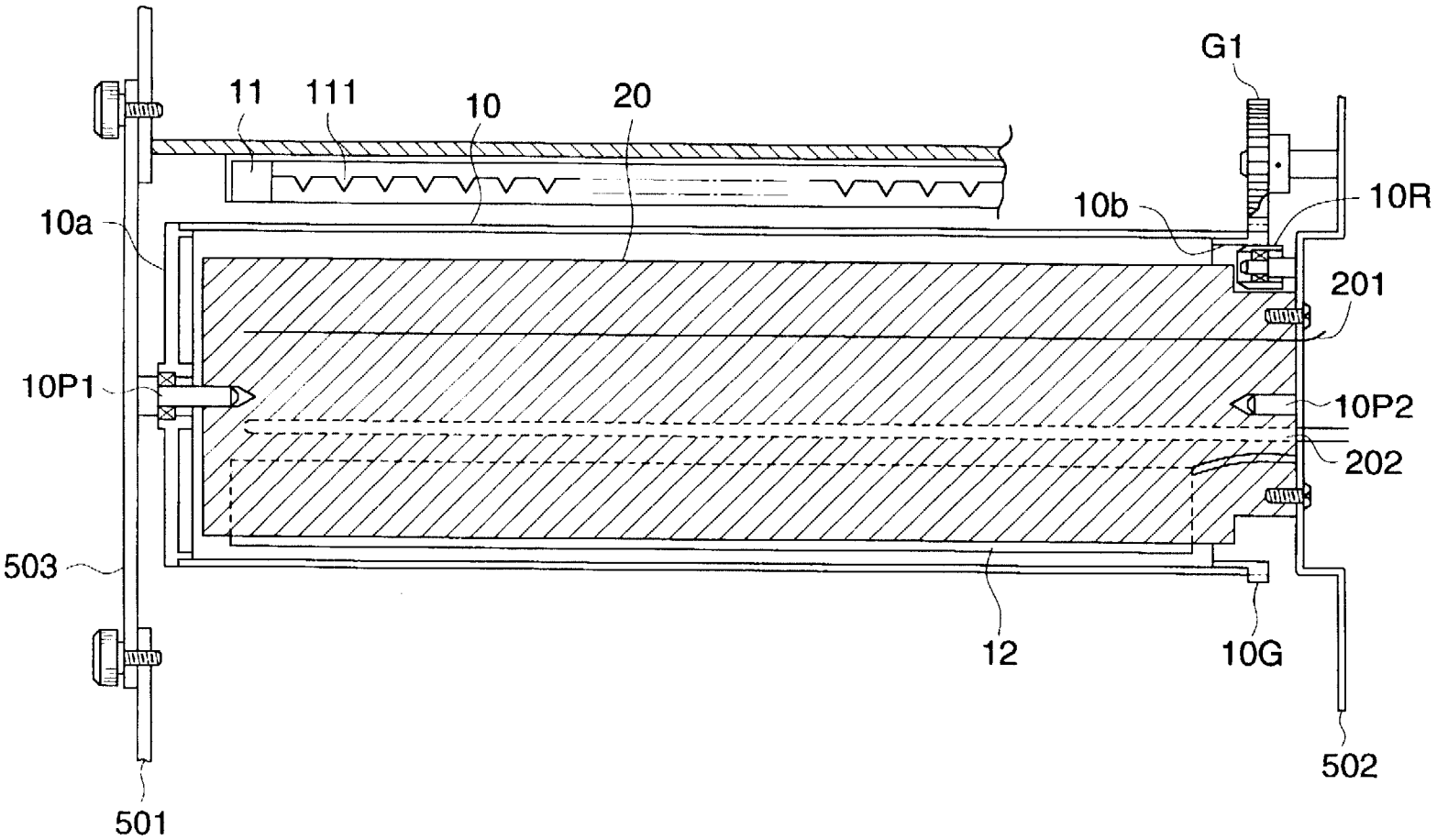
FIG. 2 is a side sectional view of an image carrier in FIG. 1.
Figure 3:
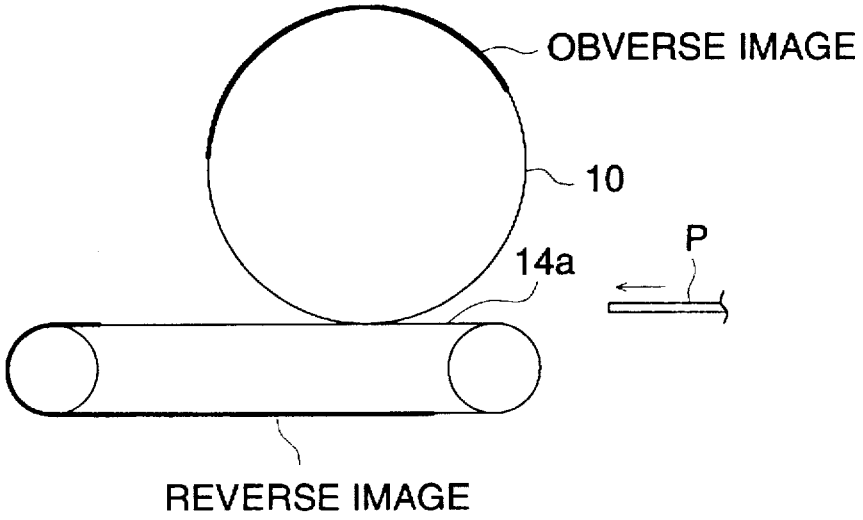
FIG. 3 is a view showing double-sided toner image forming conditions of the first example of the present invention.
Figure 4:
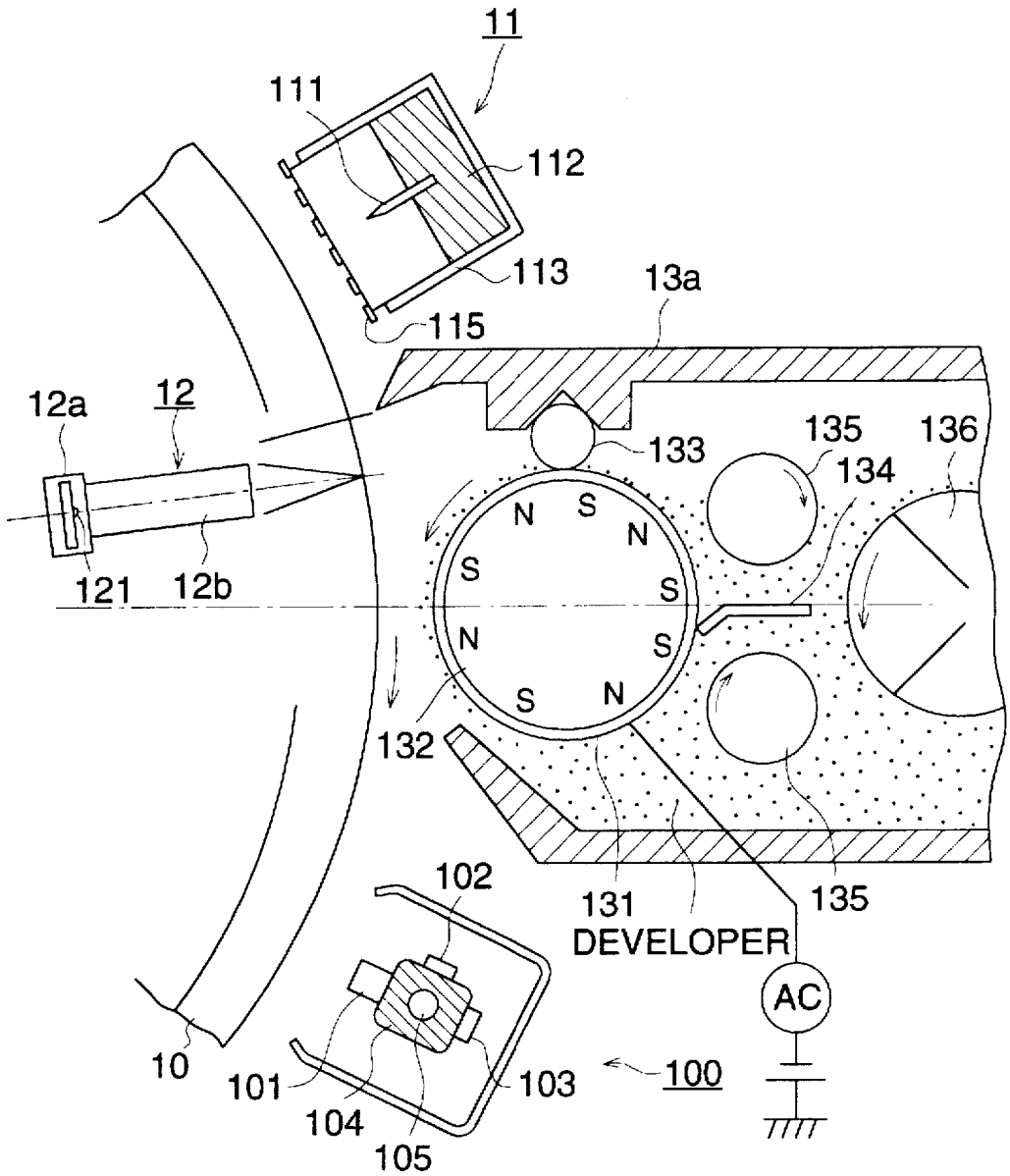
FIG. 4 is an enlarged view of primary portions of the apparatus and shows conditions of potential voltage measurement.
Figure 5:
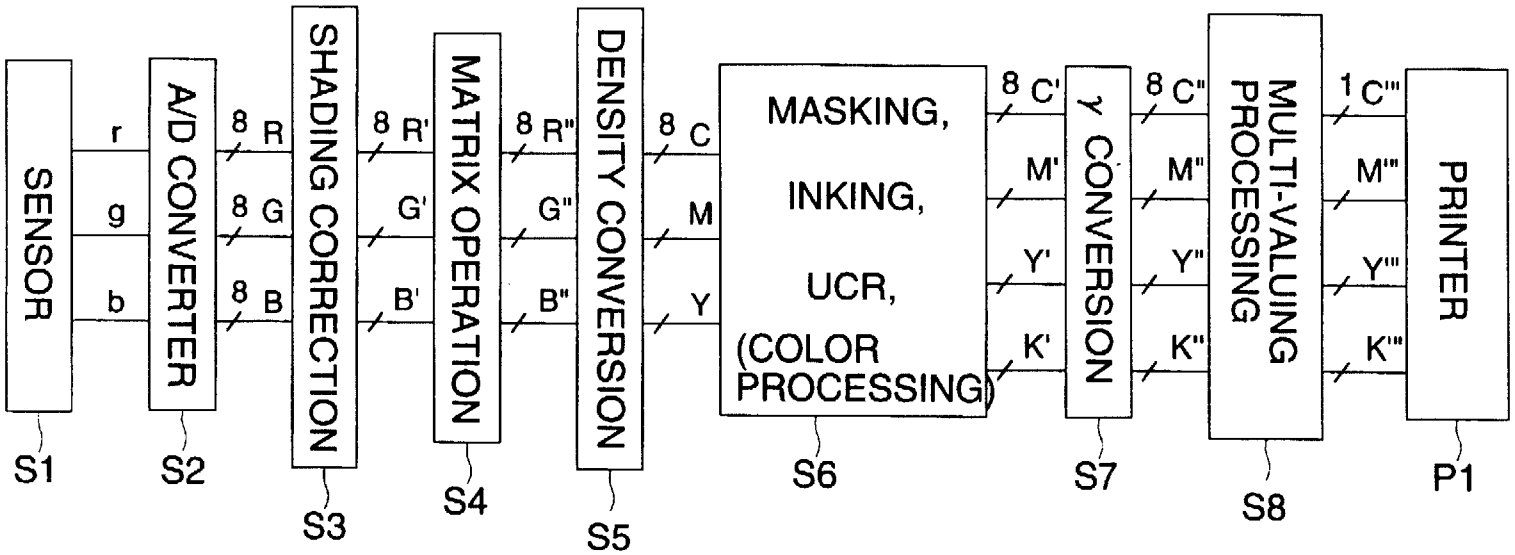
FIG. 5 is a view showing an example of a digital image processing system for color reproduction.

Referring to FIGS. 1 through 5, an image forming process and each mechanism of the first example of an image forming apparatus of the present invention will be described below. FIG. 1 is a sectional view of the structure of a color printer as a color image forming apparatus showing the first example of the image forming apparatus of the present invention. FIG. 2 is a side sectional view of the image carrier in FIG. 1. FIG. 3 is a view showing a double-sided toner image forming conditions of the first example. FIG. 4 is an enlarged view of primary portions in FIG. 1, and shows potential voltage measurement conditions. FIG. 5 is a view showing an example of a digital image processing system for color reproduction.

A photoreceptor drum 10, which is an image carrier, is provided inside with a cylindrical base body formed of a transparent member of, for example, glass or transparent acrylic resin, and is also provided with a transparent conductive layer, and a photoreceptor layer such as an a-Si layer, an organic photoreceptor layer (OPC), etc., on the outer periphery of the cited base body.

The photoreceptor drum 10 is mounted between a front flange 10*a* and a rear flange 10*b*; the front flange 10*a* is pivoted by a guide pin 10P1 provided on a cover 503, attached to a front side plate 501 of the apparatus main body; the rear flange 10*b* is engaged on the outer surface of a plurality of guide rollers 10R, provided on a rear side plate 502 of the apparatus main body; and thereby the photoreceptor drum 10 is held. A gear 10G, provided on the outer periphery of the rear flange 10*b*, is engaged with a driving gear G1, and by its driving power, the photoreceptor drum 10 is rotated clockwise as shown in FIG. 1, while the transparent conductive layer is electrically grounded.

In the present example, the transparent base body may have only an amount of exposure, which can form an appropriate contrast on a light conductive layer of the photoreceptor drum. Accordingly, it is not necessary that the light transparency factor of a transparent base body of the photoreceptor drum be 100%, but may have a characteristic in which some amount of light is absorbed at the time of transmission of the exposure beam. As light transmissive base body materials, acrylic resins, specifically, polymers incorporating a methyl methacrylate monomer, are excellent for the transparency, strength, accuracy, surface property, etc., and are preferably used. Further, any type of light transmissive resins such as acryl, fluorine, polyester, polycarbonate, polyethylene terephthalate, etc., which are used for general optical members, may be used. The material may even be colored if it still has light permeability with respect to the exposure light beams. As a light conductive layer, indium, tin oxide (ITO), lead oxide, indium oxide, copper iodide, or a metallic film, in which light permeability is still maintained, and which is formed of Au, Ag, Ni, Al, etc., can be used. As film forming methods, a vacuum deposition method, an activated reaction deposition method, any type of spattering method, any type of CVD method, any dip coating method, any spray coating method, etc., can be used. As light conductive layers, an amorphous silicon (a-Si) alloy photoreceptor layer, an amorphous selenium alloy photoreceptor layer, or any type of organic photoreceptor layer (OPC), can be used.

A scorotron charger 11, which is a charging means, is used for image forming processes of each color of yellow (Y), magenta (M), cyan (C) and black (K). The charger is mounted in the direction perpendicular to the moving direction of the photoreceptor drum 10 which is an image carrier, and opposed to the photoreceptor drum 10; and it charges (negative charging in the present example) the organic photoreceptor layer on the photoreceptor drum 10 by a corona discharge with the same polarity as the toner, by using a control grid 115 having a predetermined potential voltage and, for example, a saw tooth type electrode as a corona discharge electrode 111, so that a uniform potential voltage is applied onto the photoreceptor drum 10. As the corona discharge electrode 111, a wire electrode can also be used instead of the above cited electrode.

As shown in FIG. 4, the scorotron charger 11 is structured as follows: a C-shaped side plate 113, which is a shielding member, and the saw-toothed corona discharge electrode 111, are attached onto the support member 112; and a control grid 115 is attached onto the support member 112, opposed to the corona discharge electrode 111.

An exposure unit 12, as an image exposure means for each color, is arranged in such a manner that the exposure position on the photoreceptor drum 10 is set upstream in the rotational direction of the photoreceptor drum with respect to a developing sleeve 131, between the corona discharge electrode 111 of the scorotron charger 11 and the developing position of a developing device 13.

An exposure unit 12 is structured as a unit for the exposure, onto which a linear exposure element 12*a*, in which a plurality of LEDs (light emitting diodes) 121 as a light emitting element for image exposure lights are arrayed, and a Selfoc lens 12*b* as a life-sized image forming element, are attached onto a holder (not shown), wherein the LEDs and the Selfoc lens are arranged in the primary scanning direction parallel to the axis of the photoreceptor drum 10. The exposure unit 12 for each color, a uniform exposure device 12*c* and a transfer-simultaneous exposure device 12*d* are attached onto a cylindrical holding member 20 which is fixed by being guided by a guide pin 10P2, provided on a rear side plate 502 of the apparatus main body, and another guide pin 10P1, provided on a cover 503 attached on a front side plate 501, and is accommodated inside the base body of the photoreceptor drum 10. Image data for each color, which has been read by an image reading apparatus, provided separately from the apparatus maim body, and stored in a memory, is sequentially read from the memory and respectively inputted into the exposure unit 12 for each color as electrical signals.

As the exposure elements, a linear exposure element in which a plurality of light emitting elements such as Fls (fluorescent material emission elements), Els (electroluminescence elements), PLs (plasma discharge elements), LEDs (light emitting diodes), etc., are aligned array-like, is used other than the above-described elements. The wavelength of light emission of the light emitting elements used in the present invention is preferable in the range of 680–900 nm, in which the permeability of Y, M, C toners is normally high. However, because image exposure is carried out from the rear surface of the photoreceptor drum, the shorter wavelength, which has insufficient transparency for color toner, may be used.

Regarding color sequence of the image formation, the developing devices, provided around the rotating photoreceptor drum according to the color sequence, are arranged in the present example as follows: with respect to the rotational direction of the photoreceptor drum 10 shown by an arrow in FIG. 1, the Y and M developing devices 13 are arranged on the left side of the photoreceptor drum 10; the C and K developing devices are arranged on the right side of the photoreceptor drum 10; the Y and M scorotron chargers 11 are arranged below developing casings 138 of the Y and M developing devices; and the C and K scorotron chargers 11 are arranged above developing casings 138 of the C and K developing devices.

The developing devices 13, which are developing means for each color, respectively accommodate one-component or two-component developers for yellow (Y), magenta (M), cyan (C) and black (K), and are provided with developing sleeves 131, formed of, for example, cylindrical non-magnetic stainless steel or aluminium material of 0.5–1 mm thickness, and of 15–25 mm outer diameter, developing sleeves being respectively rotated in the same direction as the photoreceptor drum 10 at the developing position, while keeping a predetermined gap with respect to the peripheral surface of the photoreceptor drum 10. As shown in FIG. 4, a fixed magnet 132 is included in the developing sleeve 131; N and S magnetic poles are alternately arranged and coaxially fixed with the developing sleeve, and exert magnetic force onto the peripheral surface of the non-magnetic sleeve. A thin layer forming rod 133 as a thin layer forming member, is one which regulates the layer thickness of the two-component developer on the peripheral surface of the developing sleeve 131, is made of a metallic material of a circular section of a magnetic body having 3–10 mm diameter, and is in uniform predetermined pressure contact with the peripheral surface of the developing sleeve 131. A scraper 134, which removes the two-component developer from the developing sleeve 131, is made of a plate-like elastic member such as, for example, SUS, urethane rubber, etc., provided such that one edge of length of the strip is in pressure contact with the developing sleeve 131 and in parallel to it. Stirring screws 136 and 137 are rotated with the same speed in the counter direction to each other, and stir and mix toner and carrier in the developing device 13 to form the two-component developer uniformly including a predetermined toner component. Further, the two-component developer is supplied to a stirring section, and is conveyed and supplied from the stirring section to the developing sleeve 131, by a supply roller. Numeral **13*a*** represents a developing casing.

The developing device 13 is maintained to be in non-contact with the photoreceptor drum 10 by a roller, not shown, while keeping a predetermined gap, for example, of 100–1000 μm. At a developing operation by the developing device 13 for each color, a developing bias voltage of a DC voltage, or further an AC voltage AC in addition to the DC voltage, is applied on the developing sleeve 131; jumping development is carried out by the one-component or two-component developer accommodated in the developing device; a DC bias voltage having the same polarity as the toner (negative polarity in the present example), is applied on the negatively charged photoreceptor drum 10 in which a transparent conductive layer is grounded; and non-contact reversal development is carried out by toner adhering onto the exposure section.

The developing device 13 for each color reversal develops an electrostatic latent image on the photoreceptor drum 10, which is formed by charge of the scorotron charger 11 and image exposure by the exposure unit 12, in a no-contact condition, by the non-contact development method by application of a development bias voltage, by using toner having the same polarity as the charged polarity (in the present example, the photoreceptor drum is negatively charged, and the polarity of toner is also negative).

As shown in FIG. 4, a sensor unit 100 is composed of a potential voltage sensor 101 attached to a sensor attaching member 104 which is rotatable around the support shaft 105, a reflection density sensor 102 using infrared rays for Y, M and C, and a reflection density sensor 103 for K. Further, as shown in FIG. 1, the sensor 100 is arranged downstream of the developing device 13 for K, which is located at the most downstream position in the rotational direction of the photoreceptor drum 10, in the developing devices for Y, M, C, K, which are a plurality of developing devices arranged in the sequence of toner image formation.

The use of infrared rays is for the reason that Y, M and C toners respectively have a high spectral reflection factor in the infrared range, and therefore it can be used in common. Further, K toner has a low reflection factor in the infrared range when carbon system color materials are used, and therefore, it is not used in common. Of course, when k toner is made of a color material having high spectral reflection factor for infrared range, and therefore it is not used with other toners. Of course, when K toner is made of a color material having high spectral reflection factor in the infrared range, it can be used with the other toners.

Regarding the sensor unit 100, the potential voltage sensor 101, the reflection density sensor for Y, M, C 102, and the reflection density sensor for K 103 are arranged under the condition that they are not opposed to the photoreceptor drum 10 surface and are withdrawn from the drum surface during color image formation.

Images read by image pick-up elements of an image reading apparatus, separated from the present apparatus, or images edited by a computer, as a document image, are temporarily stored in a memory as image data for each color of Y, M, C and K.

A photoreceptor driving motor, not shown, is started at the start of image recording; a gear 10G provided on a rear flange **10*b* of the photoreceptor drum 10 is rotated through a driving gear G1; the photoreceptor drum 10 is rotated clockwise as shown by the arrow in FIG. 1; and simultaneously, application of potential voltage is started on the photoreceptor drum 10 by the charging operation of the Y scorotron charger 11, which is located below the developing casing 138 of the yellow (Y) developing device 13, located to the left of the photoreceptor drum 10**.

After application of the potential voltage on the photoreceptor drum 10, exposure by electrical signals corresponding to the first color signal, that is, Y image data, is started by the Y exposure unit 12, and an electrostatic latent image is formed on the photoreceptor layer of the photoreceptor drum 10 corresponding to the Y image of the document image by rotational scanning of the drum.

The latent image is reversal-developed by the Y developing device 13 under non-contact condition of developer on the developing sleeve, and a yellow (Y) toner image is formed on the photoreceptor drum 10 corresponding to its rotation.

Next, potential voltage is applied on the yellow (Y) toner image formed on the photoreceptor drum 10, by the charging operation of the scorotron charger 11 for magenta (M) which is located on the left of the photoreceptor drum 10, above the developing device 13 for yellow(Y), and below the developing casing 138 of the developing device 13 for magenta (M); exposure is carried out by electrical signals corresponding to the second color signal of the exposure unit 12, that is, image data of M; and then, the magenta (M) toner image is formed by successively being superimposed on the yellow (Y) toner image by the non-contact reversal development by the developing device 13 for M.

Further, in the same process, the cyan (C) toner image corresponding to the third color signal is formed by the scorotron charger 11 for cyan (C), located on the right of the photoreceptor drum 10 and above the developing casing 138 of the developing device 13 for cyan (C), the exposure unit 12 for C, and the developing device 13 for C; and the black (K) toner image corresponding to the fourth color signal is successively formed by being superimposed on other toner images by the scorotron charger 11 for black (K), located on the right of the photoreceptor drum 10, below the developing device for C and above the developing casing 138 of the developing device 13 for black (K), the exposure unit 12 and developing device 13; and a full color toner image is formed on the peripheral surface of the photoreceptor drum 10 during a single rotation (the toner image forming means).

The exposure onto the organic photoreceptor layer of the photoreceptor drum 10 by the exposure units for Y, M, C and K is carried out from the inside of the drum through the transparent base body. Accordingly, the exposure for the image corresponding to the second, third and forth color signals is carried out without influence of the previously formed toner images, so that the electrostatic latent image similar to the image corresponding to the first color signal ban be formed. In this connection, temperature and the temperature rise inside the photoreceptor drum 10 caused by heat generation of the exposure optical systems 12, can be stabilized or prevented, and suppressed to an acceptable degree by countermeasures in which a good heat conductivity material is used for the holding member 20; a heater 201 is used when the interior temperature is low; heat is radiated outside through a heat pipe 202 when the interior temperature is high, or by similar means.

By the image forming processes, a superimposed color toner image, which is a reverse surface image, is formed on the photoreceptor drum 10 (the first image carrier mean), which is the image carrier. The superimposed color toner image as the reverse surface image on the photoreceptor drum 10 is collectively transferred onto a toner image receiving body **14*a* (the second image carrier means), which is stretched between the driving roller 14*d* and the driven roller 14*e*, and is provided close to the photoreceptor drum 10 or in contact with the drum, by the transfer device 14*c* for applying a voltage having reverse polarity of the toner, (positive polarity in the present example), in the transfer area 14*b*. At this time, in order to conduct an excellent transfer, the uniform exposure is carried out by the transfer simultaneous exposure device 12*d*** using, for example, light emitting diodes.

Toner remaining on the peripheral surface of the photoreceptor drum 10, after transfer, is discharged by an image carrier AC discharger 16. Then, the toner is moved to a cleaning device 19, and is cleaned by a cleaning blade **19*a* made of a rubber material, which is in contact with the photoreceptor drum 10. Further, in order to eliminate the hysteresis of the photoreceptor due to the previous printing, the peripheral surface of the photoreceptor is discharged by a uniform exposure device 12*c*** using, for example, a light emitting diode, before charging, so that electrical charges from the previous printing are eliminated, and following that, the color image formation for the obverse image is conducted.

The obverse image of the superimposed color toner image is formed on the photoreceptor drum 10 in the same manner as the above cited color image forming process, in synchronization with the reverse image formed on the toner receiving body **14*a* in the transfer area 14*b***. It is necessary to change image data so that the obverse image formed at the time, forms a mirror image with respect to the reverse image on the image carrier.

A recording sheet P, which is a transfer material, is sent from a sheet feed cassette 15, which is a transfer material accommodation means, by a feed roller **15*a*, and fed and conveyed to a timing roller 15*c* by a sheet feed roller 15*b***.

The recording sheet P is sent to the transfer area **14*b* by the timing roller 15*c* in synchronization with the color toner image as the obverse image carried on the photoreceptor drum 10, and the color toner image as the reverse image carried on the toner image receiving body 14*a*. In this case, the recording sheet P is paper-charged to the same polarity as the toner by a paper charger 14*f*, is attracted to the toner image receiving body 14*a*, and is sent to the transfer area 14*b***. By paper-charging the recording sheet P to the same polarity as the toner, it prevents the recording sheet P to be attracted to each other by the toner image on the toner image receiving body, or the toner image on the image carrier, so that the toner image is not disturbed.

The obverse image on the peripheral surface of the photoreceptor drum 10 is collectively transferred onto the upper surface side of the recording sheet P by the transfer device which applies voltage with reversed polarity as the toner **14*c* (in the present example, positive polarity), (the first transfer means). In this case, the reverse image on the peripheral surface of the toner image receiving body 14*a* is not transferred onto the recording sheet P, and exists on the toner image receiving body 14*a*. Next, the reverse image on the peripheral surface on the toner image receiving body 14*a* is collectively transferred onto the lower surface of the recording sheet P, by a reverse surface transfer device 14*g* which has applied the voltage with reversed polarity as the toner (in the present example, positive polarity), (the second transfer means). At the time of transferring by the transfer device 14*c*, uniform exposure by the transfer simultaneous exposure device 12*d* using, for example, a light emitting diode, which is provided inside the photoreceptor drum 10 opposed to the transfer device 14*c***, is carried out so that excellent transferring can be carried out.

Because a toner image for each color is superimposed on previous ones, it is preferable for the collective transfer, that the upper layer and the lower layer of the toner layer are charged by the same charging amount and with the same polarity. For this reason, the double-surface image formation, in which the polarity of the color toner image formed on the toner image receiving body **14*a*** is reversed by corona charging, or in which the polarity of the color toner image formed on the image carrier is reversed by corona charging, is not preferable because the lower layer toner is not sufficiently charged with the same polarity, resulting in inadequate transfer.

It is preferable for an increase of the transfer property of the reversal image formation that the reversal development is repeated on the image carrier; the color toner image with the same polarity formed by superimposition, is collectively transferred onto the toner image receiving body 14*a* while the polarity is not changed; and next, it is collectively transferred onto the recording sheet P while the polarity is not changed. Also for the obverse image formation, it is preferable that the reversal development is repeated on the image carrier, and the color toner image with the same polarity formed by superimposition, is collectively transferred onto the recording sheet P while the polarity is not changed, for an increase of the transfer property of the obverse image formation.

From the above description, in the full color image formation, the double-surface image formation method is preferably adopted in which the color toner image is formed on the obverse surface of the transfer material by operating the first transfer means, and next, the color toner image is formed on the reverse surface of the transfer material by operating the second transfer means, by using the above-described image formation method for both the obverse and reverse surfaces.

Toner image receiving body 14*a* is a 0.5–2.0 mm thick endless rubber belt, and is structured of 2 layers of a semi-conductive base body, having a resistance value of $10^8$–$10^{12}$ Ω•cm, which is formed of silicon rubber or urethane rubber, and a 5–50 μm thick fluorine coating layer as a toner filming prevention layer, formed on the rubber base body. This layer is also preferably semi-conductive. Instead of the rubber belt base body, a 0.1–0.5 mm thick semi-conductive polyester, polystyrene, polyethylene, polyethylene terephthalate material, etc., may also be used.

The recording sheet P, on the double-surfaces of which the color toner image has been formed, is discharged by a sheet separation AC discharger 14*h* for transfer material separation, separated from the toner image receiving body 14*a*, and is conveyed to a fixing device 17 as a fixing means, composed of 2 rollers respectively housing a heater. Adhered toner on the obverse and reverse sides of the recording sheet P is fixed by application of a heat and pressure between a fixing roller 17*a* and a pressure roller 17*b*; and the recording sheet P on both sides of which images have been recorded, is sent by sheet delivery rollers 18 and delivered onto a tray provided outside the apparatus.

Toner remaining on the peripheral surface of the toner image receiving body 14*a* after transferring, is removed by a toner image receiving body cleaning device 14*i*. Toner remaining on the peripheral surface of the photoreceptor drum 10 after transferring is discharged by an image carrier AC discharger 16; is then moved into the cleaning device 19; scraped off by a cleaning blade 19*a*, made of a rubber material, being in contact with the photoreceptor drum 10 into the cleaning device 19; and is collected into a waste toner container, not shown, by a screw 19*b*. The photoreceptor drum 10, from the surface of which the remaining toner has been removed by the cleaning device 19, is uniformly charged by the Y scorotron charger 11, and then enters into the next image formation cycle.

Color image formation described above is carried out by the control of the image data processing condition in the digital image processing section by steps S1–S8, as shown in FIG. 5, and by the control of the processing condition of the image formation for the charging means, image exposure means, developing means, etc., in the printer section P1.

The amount of toner adhered on the reverse image is respectively reduced by approximately 10% during transferring from the image carrier onto the toner image receiving body, and from the toner image receiving body onto the recording sheet P. Accordingly, regarding the reverse image, the image density is lower, or the toner image is scattered (half tone dots are spread out and normally γ is increased) by 2-time transferring and gradation changes, as compared to the case of the obverse image, which is only transferred from the image carrier onto the recording sheet P. Further, in the full color image, the sequence of superimposition of toner images is reversed on the recording sheet P, and thereby, the color tone changes. Accordingly, in order to increase the amount of toner adhered on the reverse image or to adjust the color tone during image formation, the printer section is required to operate corresponding to the change of a charging potential voltage by the measurement using a potential voltage sensor 101, or to the change of the processing conditions such as image exposure light or developing conditions, depending on the obverse image formation and the reverse image formation. Further, the above changes can also be carried out in the image processing section, and the setting of parameters for color correction shown by a masking processing section S6, or even the γ-conversion shown by step S7, can also be carried out.

In an example described below, the potential voltage sensor 101 sequentially measures a plurality of potential patterns formed by a plurality of Y, M, C and K charging means and the image exposure means corresponding to the charging means, at the one fixed position, and controls the charging potential voltage of Y, M, C, K and the amount of image exposure light. After adjustment of the charging potential voltage of Y, M, C, K charging means and the light amount adjustment of the image exposure light of Y, M, C, K image exposure means, the reflection density sensor 102, 103 operates Y, M, C, K developing means corresponding to the adjusted Y, M, C, K potential patterns, and forms Y, M, C, K toner image patterns. The reflection densities of Y, M, C, K toner image patterns are sequentially measured by the single reflection density sensor 102, 103, and a γ-correction table for each color is made. By using the γ-correction table for each color, γ-correction is carried out for each color, or the reflection densities of Y, M, C toner image patterns are sequentially measured, and parameters for color correction for each color are set.

Initially, the correction corresponding to the obverse image will be described below.

Figure 6:
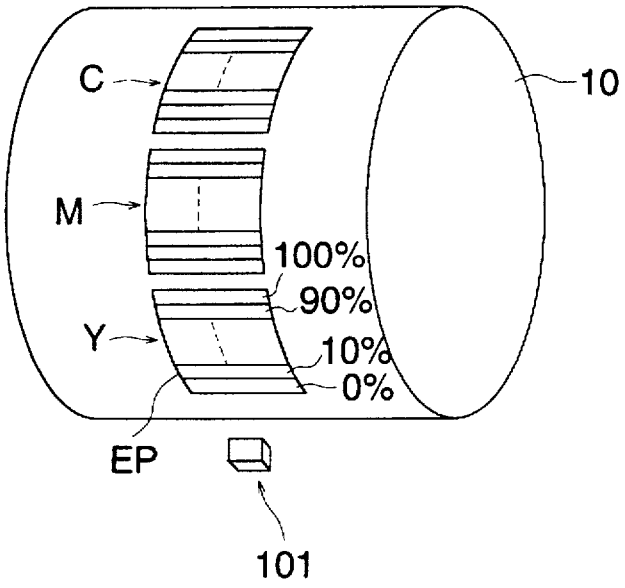
FIG. 6 is a view showing a potential voltage pattern.
Figure 7:
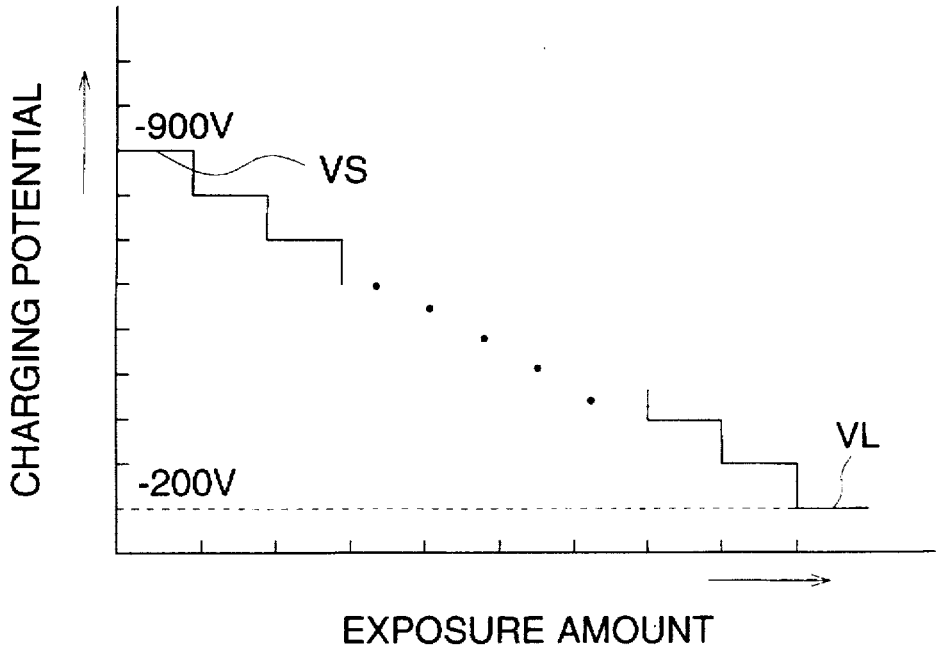
FIG. 7 is a view showing correction of the potential voltage pattern.

Initially, the correction of the charging potential voltage and the light amount of the image exposure light by the potential voltage sensor 101 will be described below, referring to FIGS. 6, 7 and 4. FIG. 6 is a view showing the potential patterns, and FIG. 7 is a view showing the correction of the potential pattern.

As described in the image formation process above, uniform charging is carried out by the scorotron charger 11. Next, exposure of 0–100% (the maximum output of the LED) of the LED 121 output is continuously carried out stepwise, for example, in 10% increments, by using the pulse width modulation according to test patterns stored in the memory of the control section, not shown, by the LED 121 as the light emitting element of the exposure unit 12, provided inside the photoreceptor drum 10, and the stepped and continuous potential patterns EP are formed on the photoreceptor drum 10 as shown in FIG. 6. The potential pattern EP for each color of Y, M, C and K (not shown), is formed on the photoreceptor drum 10 by the scorotron charger 11 and the exposure unit 12 for each color.

In this case, the scorotron charger 11 for the process following the process in which the potential pattern has been formed, is not operated. That is, in the case of formation of the potential pattern for M, only scorotron chargers for Y and M are operated, and those for C and K are not operated. If this method is not adopted, the formed potential pattern is eliminated.

In this case, the potential voltage sensor 101, provided on a sensor attachment member 104 of the sensor unit 100, is rotated around the support shaft 105 to a position opposite to the surface of the photoreceptor drum 10, wherein the sensor unit 100 is located downstream of the K developing device 13, positioned at the most downstream position in the rotational direction of the photoreceptor drum 10, in the Y, M, C, K developing devices 13, which are a plurality of developing means, sequentially arranged in the order of toner image formation.

The charging potential voltage of stepped potential patterns EP for each color of Y, M, C and K, formed on the photoreceptor drum 10, is successively measured by the potential voltage sensor 101. Development by the developing device 13 for each color stops during formation of the potential voltage pattern EP, and also during measurement of the charging potential of the potential pattern EP, by the potential voltage sensor 101.

As shown in FIG. 7, potential voltage attenuation characteristics with respect to the photoreceptor drum 10 are adjusted as follows: the maximum charging potential voltage VS of the stepped charging potential voltage, measured by the potential voltage sensor 101, is adjusted to, for example, −900 V by adjusting the grid voltage applied onto a control grid 115; or the minimum charging potential voltage VL which is determined by the maximum exposure amount of an LED 121, is set to, for example, −200 V by adjusting the current value of the LED 121.

The maximum exposure amount of the LED 121 to set the minimum charging potential voltage VL is adjusted by using a value, for example, of 80% or 60% of the maximum output of the LED 121. The grid voltage adjustment by the control grid 115, and setting of the potential voltage attenuation characteristic by the current value adjustment of the LED 121 are carried out for each color.

In the above description, the adjustment of developing bias voltage applied to the developing device 13, or the number of rotations of the developing sleeve, can also be used instead of the adjustment by the charging potential voltage and exposure amount.

Figure 8:
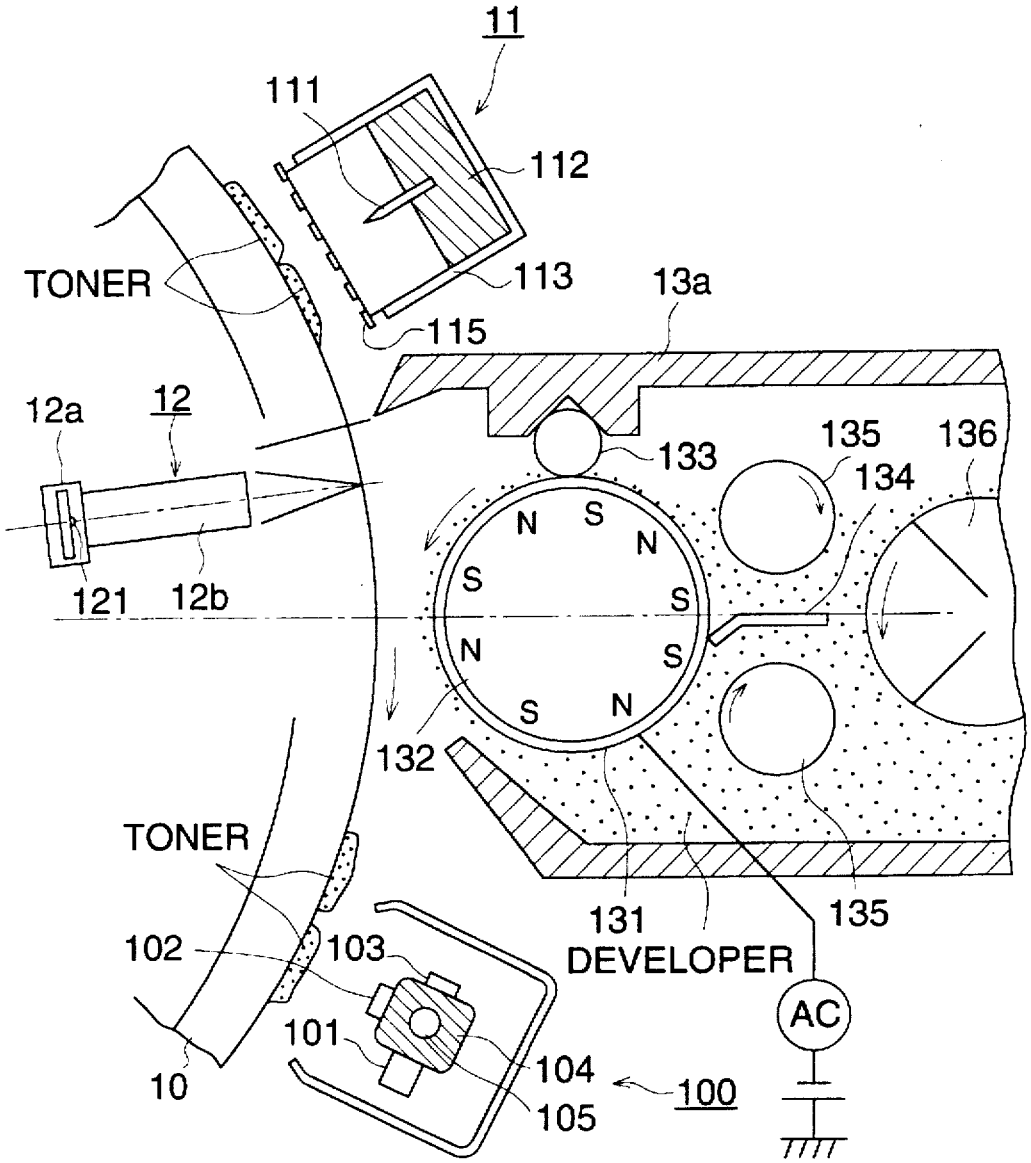
FIG. 8 is an enlarged view of primary portions of the apparatus, and shows conditions of reflection density measurement.
Figure 9:
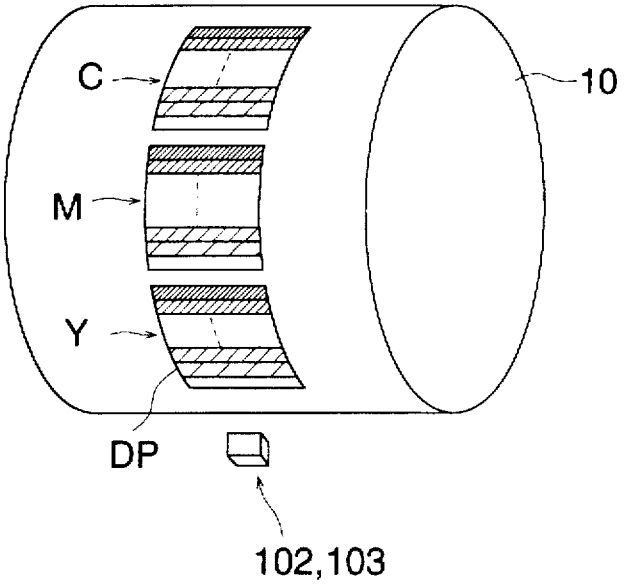
FIG. 9 is a view showing a toner pattern.
Figure 10:
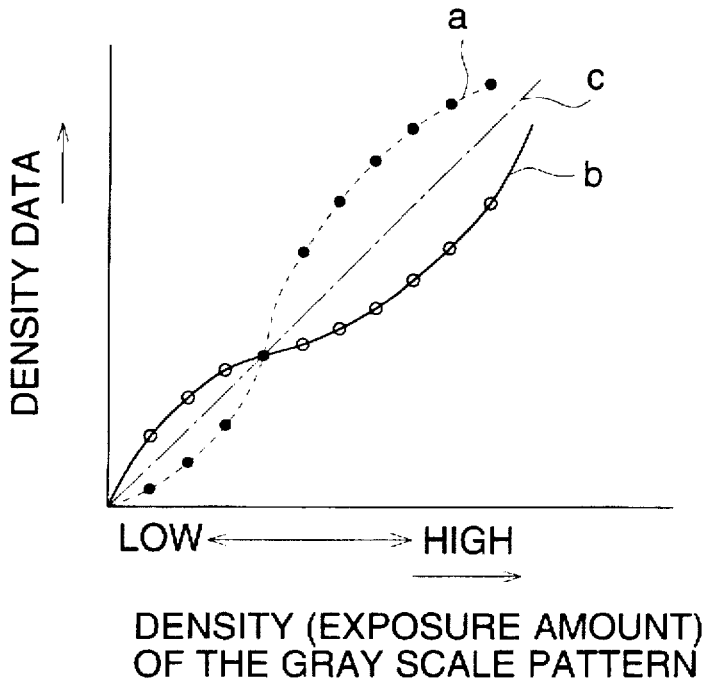
FIG. 10 is a view explaining the g-correction.

Next, referring to FIGS. 8–10.formation of a γ-correction table to be used at the time of image data output, will be described. FIG. 8 is an enlarged view of the primary portion in FIG. 1 and shows the condition at the time of reflection density measurement. FIG. 9 is a view showing toner image patterns, and FIG. 10 is a view explaining the γ-correction.

Due to the above charging potential voltage adjustment, stepped, continuous, and corrected potential voltage patterns (gray scale patterns) are formed on the photoreceptor drum 10 which is uniformly charged by the scorotron charger 11, by using the pulse width modulation output, in which the maximum exposure amount set to, for example, 80% of the maximum output of the LED 121 is divided by, for example, 10. Following this, the developing device 13 is activated, the gray scale pattern is developed, and a toner image pattern DP is formed. The toner image pattern DP for each color of Y, M, C and K, not shown, as shown in FIG. 9, is formed on the photoreceptor drum 10 by the scorotron charger 11, exposure unit 12 and developing device 13 for each color. The toner image pattern formation process is the same as the normal color image formation process, except that only the latent image formation pattern is changed.

In this case, the reflection density sensor 102, provided on a sensor attachment member 104 of the sensor unit 100, is rotated around the support shaft 105 to a position opposite to the surface of the photoreceptor drum 10, wherein the sensor unit is located downstream of the K developing device 13, which is positioned at the most downstream position in the rotational direction of the photoreceptor drum 10, in the Y, M, C and K developing devices 13, which are a plurality of developing means and sequentially arranged in the order of toner image formation. Due to this, the potential voltage sensor 101 is prevented form being stained by toner.

Density data of the stepped toner image patterns DP for each color of Y, M, C, K, formed on the photoreceptor drum 10, are successively measured by the reflection density sensor 102. The relationship of the density (exposure amount) of the gray scale patterns by the pulse width modulation exposure light divided by 10, and density data obtained by the reflection density sensor, is shown by black spots in FIG. 10. A curve a, shown by dotted lines for connecting black spots, shows the γ-characteristic of the density data of the toner image pattern. A correction curve is determined as follows: correction values (circles) are determined with respect to the curve "a" in such a manner that the γ-characteristic is expressed by a line "c", shown by a one-dotted chain line, that is, γ=1; and γ-correction curve is shown by a curve "b". Based on the γ-correction curve, the density (exposure amount) of the gray scale patterns composed of a plurality of circles, and the values of density data are stored in a memory of the control section, not shown, as a γ-correction table. The γ-correction tables for each color of Y, M, C, and K are formed and stored in the memory. Practically, γ is set to a value slightly higher than 1 (slightly hard as an image).

A γ-correction table for black (K) may be formed by individually measuring only the black toner density pattern, using the reflection density sensor 103 under the condition that the reflection density sensor 103 is in the operating mode, facing the photoreceptor drum 10.

As shown in FIG. 1, the image read by an image pick-up element of the image reading apparatus, provided separately from the color image forming apparatus, or the image edited by a computer, is temporarily stored in a memory as image data for each color of Y, M, C and K. At image recording, the stored image data sets the exposure amount (density of the gray scale pattern) corresponding to density data, by using the corresponding γ-correction table for Y, M, C and K, according to the values of density data of the image data for Y, M, C and K; and by using the exposure amount, the LED 121 arranged array-like, as the exposure element, is individually activated by the pulse width modulation output.

The correction for the obverse image has been explained above, and, in the case of the reverse image, process conditions (charging potential voltage and the exposure amount) or image data are corrected in the same manner as the adjustment of the obverse image. As correction methods, adjustment for the reverse image is individually conducted in the same manner as the adjustment of the obverse image. In this case, the correction is accurately carried out in such a manner that a sensor unit 150 comprising the reflection density sensor is provided opposed to the toner image receiving body as shown in FIG. 1, and the toner image is detected for correction. Alternatively, as another correction method, a method is applied in which the correction for the process conditions (charging potential voltage and the exposure amount) or image data for the reverse image, is determined, by assuming the correction conditions for the process conditions (charging potential voltage and the exposure amount) or image data, from previously obtained experimental data for the obverse image. For example, in the case of the reverse image formation in contrast to the obverse image formation, the following adjustment conditions are previously determined: the maximum charging potential voltage VS is increased by 10%; the maximum exposure amount is increased by 10%; a tilted γ-correction curve is employed, and then, the adjustment, in which conditions for the reverse image are changed according to conditions for the obverse image, or similar adjustment, is carried out.

Figure 17:
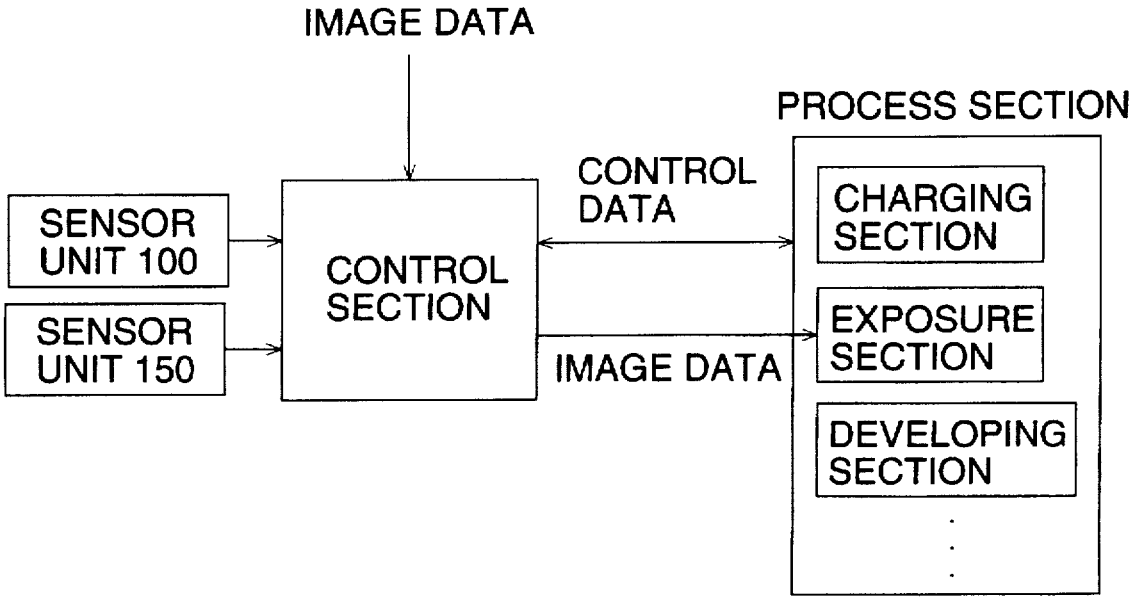
FIG. 17 is a blockdiagram showing a construction to adjust a process condition by detecting a density of a toner image.
Figure 18:
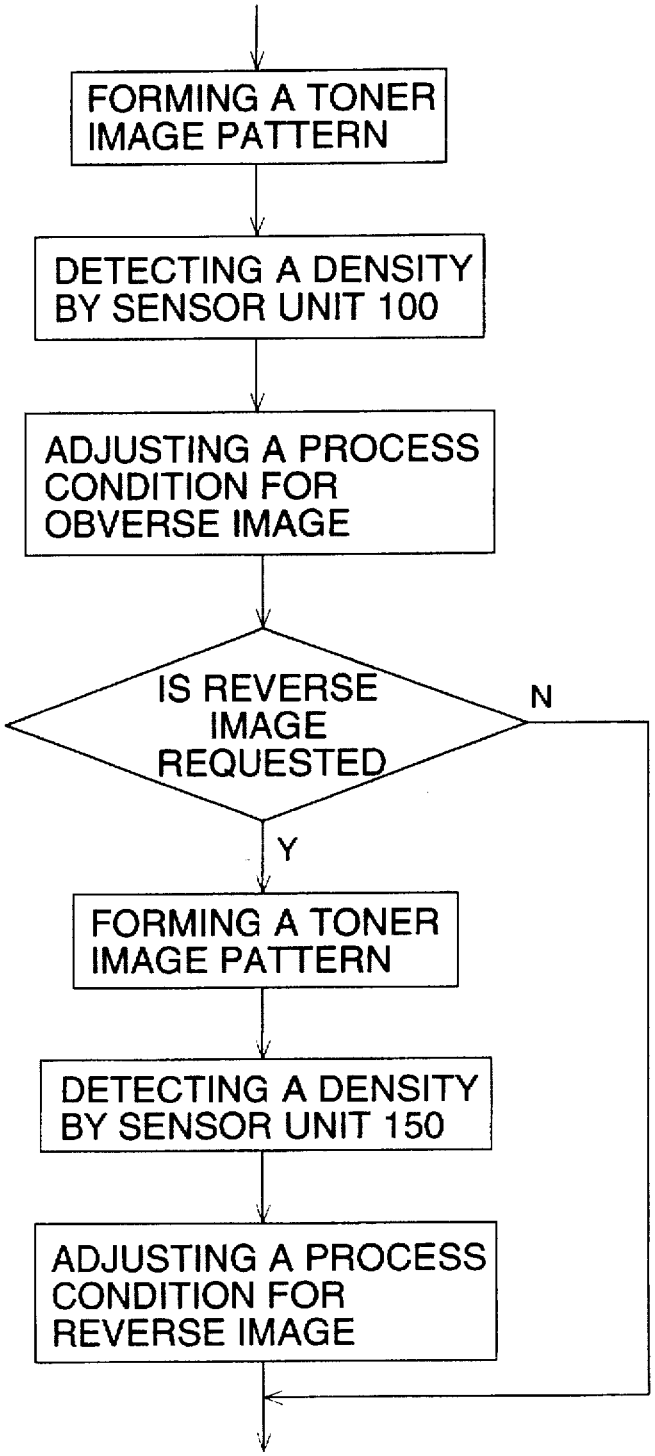
FIG. 18 is a flowchart showing a procedure for adjustment.

FIG. 17 is a blockdiagram showing a construction to adjust a process condition by detecting a density of a toner image, and FIG. 18 is a flowchart showing a procedure for adjustment.

A toner image pattern to adjust a process condition for an obverse image is formed on a photoreceptor drum, a density of the toner image is detected by the sensor unit 100, and the process condition is adjusted by the abovementioned manner. On the other hand, when a process condition for the reverse image is adjusted, a toner image pattern formed on the photoreceptor drum is transferred to a toner image receiving body, a density of the transferred toner image is detected by a sensor unit 150, and a process condition for the reverse image is adjusted based on the detected data.

Figure 19:
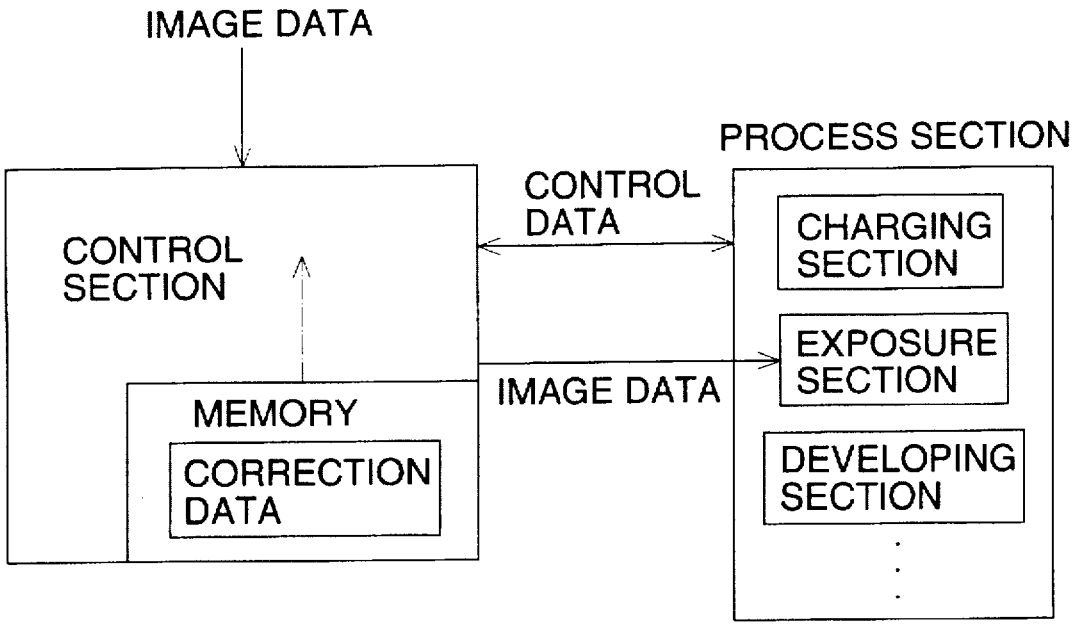
FIG. 19 is a blockdiagram showing a construction to adjust a process condition on the basis of the experimental data.

FIG. 19 is a blockdiagram showing a construction to adjust a process condition on the basis of the experimental data. A correction data for the obverse image and a correction data for the reverse image determined based on the experimental data are stored in a memory of the control section in FIG. 19 and process conditions for the obverse image and the reverse image are adjusted based on the correction data.

Figure 11:
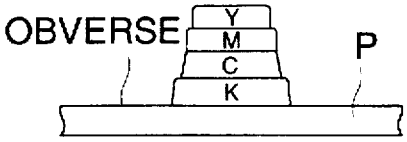
FIGS. 11(A) and 11(B) are views showing superimposed color toner images.
Figure 11:
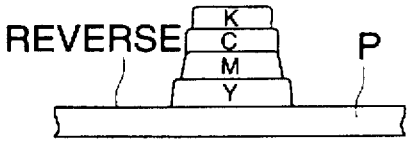

Further, change of the parameter settings for masking for the color correction shown by S6 in FIG. 5, is necessary for the color image, in addition to the correction of each density data. Superimposed color toner images formed by the color image forming apparatus, explained in FIG. 1, is shown in FIG. 11. FIG. 11(A) is a view showing a color toner image formed on the obverse surface of the transfer material. FIG. 11(B) is a view showing the color toner image formed on the reverse surface of the transfer material. When color toner images are formed in the order of Y, M, C and K by the color image forming apparatus, the obverse image is successively superimposed on the recording sheet P such that black (K) toner image is placed on the lowermost portion on the obverse surface of the sheet P, and C, M and Y toner images are sequentially superimposed on the black toner image, as shown in FIG. 11(A). Accordingly, it is necessary to adhere the K toner, which is on the lowermost layer, and the amount of which is slightly increased, onto the recording sheet P. Further, in the case of the reverse image, the yellow (Y) toner image is placed on the lowermost portion on the reverse surface of the recording sheet P, and M, C and K toner images are sequentially superimposed on the yellow toner image, as shown in FIG. 11(B). The K toner image is placed on the uppermost portion of toner images and black (K) is excessively emphasized, and therefore, it is necessary to adhere the K toner, which is located on the uppermost layer, and the amount of which is slightly reduced, onto the recording sheet P. The other Y, M, C toner images are the same as the black toner image.

Figure 12:
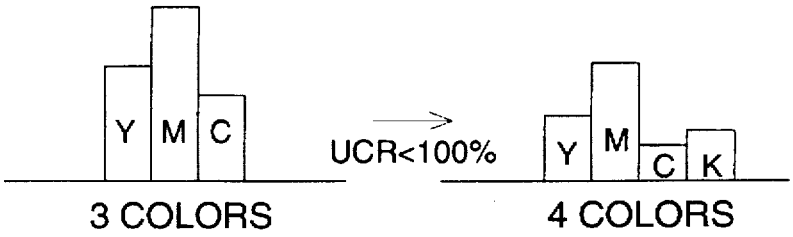
FIG. 12 is a view showing UCR.

FIG. 12 shows UCR. The image is reproduced by 3 color toners, and further 4 color toners, including black toner, according to the mixing ratio of 3 colors of Y, M, C when the UCR amount is less than 100%. This UCR is changed in the same manner as described above, depending on the obverse image and the reverse image. Further, in the case of the reverse image, the toner image is formed by 2-time transferring, and therefore, the color tone is different from the obverse image due to a decrease of the adhered amount of toner. Considering this problem, it is necessary to conduct color correction, different from that of the obverse image, in order to properly adjust the color tone in the case of the reverse image.

A masking section to conduct the above color correction, includes color processing, such as masking, inking, UCR, or the like. As masking, common linear masking, or non-linear masking or masking using a look-up table when a high grade color correction is carried out, is employed.

Figure 20:
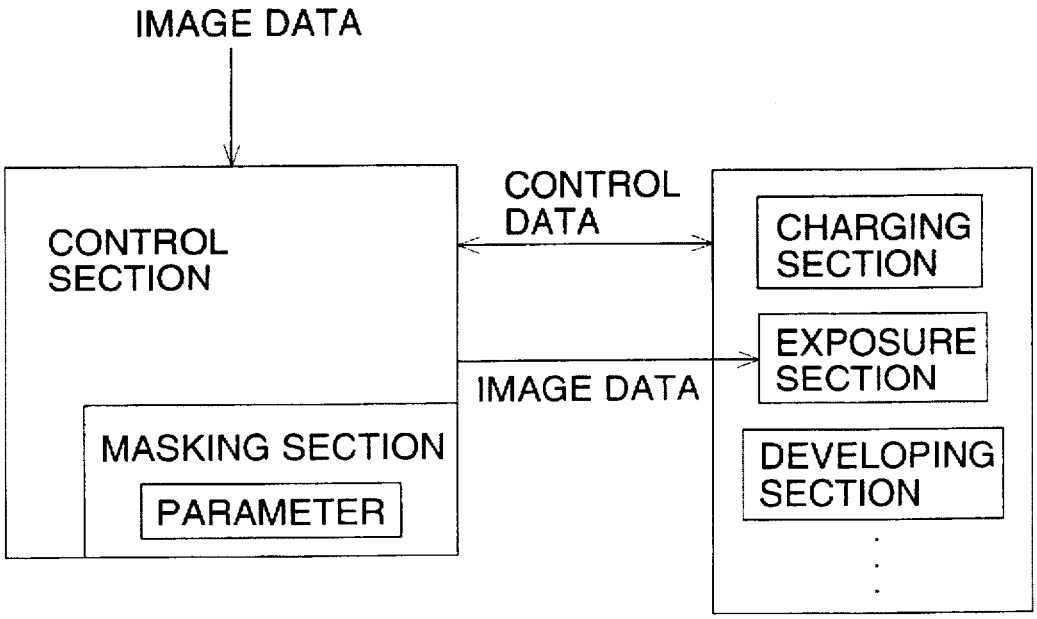
FIG. 20 is a blockdiagram showing a construction to change masking parameters between the obverse image and the reverse image.

FIG. 20 is a blockdiagram showing a construction to change masking parameters between the obverse image and the reverse image. The parameters for the obverse image and the parameters for the reverse image are prepared in the memory of the masking section in the control section in FIG. 20, thereby conducting a different color correction between the obverse image and the reverse image.

As described above, when a monochromatic or color image is formed by the color image forming apparatus, the processing conditions and the image data processing conditions, set as described above, are used for image formation, and the double-sided image formation in which the image density or color tone is properly adjusted, is carried out.

Further, as a modification, the reverse image formation may be conducted by changing conditions on only one side. Specifically, in the case of a monochromatic image, the color correction is not necessary, and when the maximum density of black is a saturation image density, an adequate image can also be reproduced even by only gradation correction.

EXAMPLE 2

Figure 13:
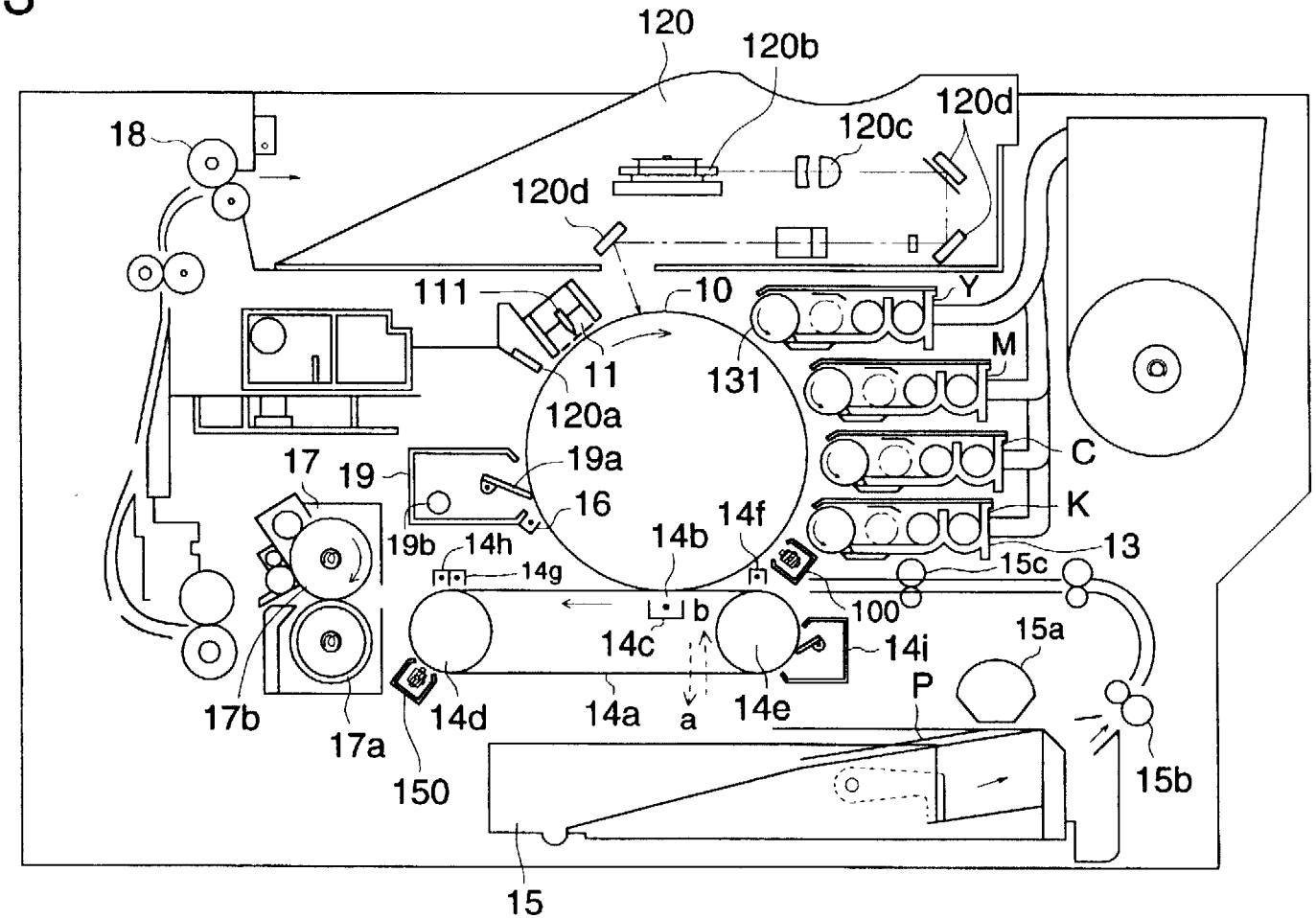
FIG. 13 is a sectional view of the structure of a color image forming apparatus of the second example of the image forming apparatus of the present invention.
Figure 14:
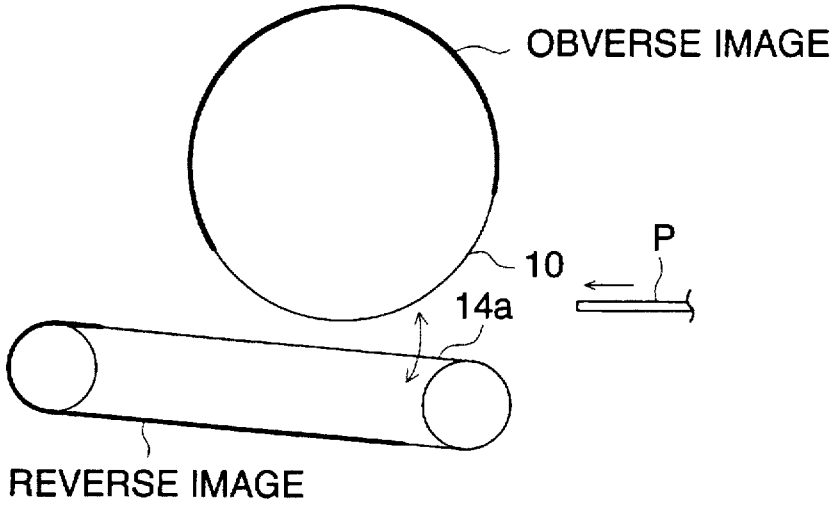
FIG. 14 is a view showing double-sided toner image forming conditions of the second example of the present invention.

Referring to FIGS. 13 and 14, the image forming process and each mechanism of the second example of the image forming apparatus of the present invention will be described below. FIG. 13 is a sectional structural view of the color image forming apparatus of the second example of the image forming apparatus of the present invention. FIG. 14 is a view showing a double-sided toner image forming situation according to the second example. The same numerals are denoted to the member having the same function and structure as that of the first example.

The toner image receiving body 14*a* stretched between the driving roller 14*d* and the driven roller 14*e*, is rotated in the direction shown by a dotted line arrow "a" in FIG. 13, around the axis of the driving roller 14*d*, and the following image formation is carried out while the toner image receiving body 14*a* is separated from the photoreceptor drum 10.

A photoreceptor drum 10, which is an image forming body, is provided inside with a cylindrical base body, and is also provided with a conductive layer, and a photoreceptor layer such as an a-Si layer or an organic photoreceptor layer (OPC), etc., on the outer periphery of the base body. The photoreceptor drum 10 is rotated clockwise as shown by an arrow in FIG. 13, while being grounded.

The photoreceptor drum 10, which is the image forming body, is rotated, the uniform exposure is conducted by a uniform exposure device 120*a*, as a discharging means before charging, for example, by a light emitting diode, in order to eliminate the hysteresis of previous printing of the photoreceptor drum 10, the peripheral surface of the photoreceptor is discharged, and charge due to the previous printing is removed.

The scorotron charger 11, as a charging means, charges (negative charging in the present example) the organic photoreceptor layer on the photoreceptor drum 10 by a corona discharge by using a control grid having a predetermined potential voltage, and a discharge electrode 11*a*, so that a uniform potential voltage is applied onto the photoreceptor drum 10.

After the peripheral surface of the photoreceptor drum 10 has been uniformly charged by the scorotron charger 11, image exposure based on the image signal is conducted by the exposure unit 120 as the image exposure means, and a latent image is formed on the photoreceptor drum 10.

The exposure unit 120, as an image exposure means, is composed of a semiconductor laser as a light emitting element, not shown, a rotational polygonal mirror 120*b*, which rotationally scans using the laser beam emitted from the semiconductor laser, an fθ lens 120*c*, a reflection mirror 120*d*, and the like. The rotational polygonal mirror 120*b* rotationally scans using the laser beam emitted from the semiconductor laser, not shown, and the image exposure is carried out according to the image signal in the primary scanning direction of the rotating photoreceptor drum 10 through the fθ lens 120*c* and the reflection mirror 120*d*, and thus the latent image is formed on the photoreceptor drum 10.

The developing device 13 for each color which is a developing means in which developer, composed of toner such as yellow (Y), magenta (M), cyan (C) and black (K) toners, and carrier are respectively loaded, is provided around the photoreceptor drum 10, and initially, development for the first color (for example, yellow) is carried out by the developing sleeve 131.

The developing device 13 reversal develops the electrostatic latent image on the photoreceptor drum 10, which is formed by charge by the scorotron charger 11 and image exposure by the exposure unit 120, under no-contact condition, by a non-contact development method with application of a development bias voltage, by using toner having the same polarity as the charged polarity (in the present example, the photoreceptor drum is negatively charged, and the polarity of toner is also negative).

The developing device 13 is maintained to be in noncontact with the photoreceptor drum 10 by a roller, not shown, while keeping a predetermined gap, for example, of 100–1000 μm. During the developing operation by the developing device 13, a developing DC bias voltage, or further an AC voltage AC in addition to the DC voltage, is applied on the developing sleeve 131; jumping development is carried out by the one-component or two-component developer accommodated in the developing device; a DC bias voltage having the same polarity as toner (negative polarity in the present example), is applied on the negatively charged photoreceptor drum 10 in which a transparent conductive layer is grounded; and non-contact reversal development is carried out for adhering toner onto the exposure section.

After development for the first color has been completed, the apparatus enters into the second color (for example, magenta) image forming process. The photoreceptor drum 10 is uniformly re-charged by the scorotron charger 11, a latent image according to the second color image data is formed by the exposure unit 120. At this time, discharge by the uniform exposure means 120*a*, which has been conducted in the first color image forming process, is not carried out. The development by the second color developer, that is, magenta developer, is conducted by the developing sleeve 131. An AC bias voltage and a DC bias voltage are superimposed and applied between the developing sleeve 131 and the photoreceptor drum 10, and non-contact reversal development is carried out.

The third color (cyan) and fourth color (black) image forming processes are carried out in the same manner as the second color, and 4 color toner images are superimposed and developed on the photoreceptor drum 10 (the toner image forming means).

By the image forming processes described above, the superimposed color toner image, as the reverse image, is formed on the photoreceptor drum 10, employed as the image forming body (the first image carrier means). The toner image receiving body 14*a* is rotated around the axis of the driving roller 14*d* in the direction shown by a dotted-line arrow "b" in FIG. 13, and is in contact with the photoreceptor drum 10. When the photoreceptor drum 10 is rotated by 5 turns, the superimposed color toner image of the reverse image on the photoreceptor drum 10, is collectively transferred onto the toner image receiving body 14*a* (the second image carrier), which is provided being in contact with the photoreceptor drum 10, by the transfer device 14*c* by which the voltage, having a reverse polarity to the toner (positive polarity in the present example), is applied in the transfer area 14*b*. It is necessary to change image data so that the obverse image, formed at that time, forms a mirror image with respect to the reverse image on the image carrier.

After the superimposed color toner image of the reverse image on the photoreceptor drum 10 has been collectively transferred onto the toner image receiving body 14*a*, the toner image receiving body 14*a* is again rotated around the axis of the driving roller 14*d* in the direction shown by the dotted-line arrow "a" the in FIG. 13, and is separated from the photoreceptor drum 10.

Toner, remaining on the peripheral surface of the photoreceptor drum 10 after transfer, is discharged by an image carrier AC discharger 16. Then, the toner is moved to a cleaning device 19, and is cleaned by a cleaning blade 19*a* made of rubber material, which is in contact with the photoreceptor drum 10. Further, in order to eliminate the hysteresis of the photoreceptor due to the previous printing, the peripheral surface of the photoreceptor is discharged by a uniform exposure device 120*a*, using, for example, a light emitting diode, before charging; electrical charges at the previous printing is eliminated; and following that, the color image formation for the obverse image is conducted.

In the same manner as the color image forming process described above, the obverse image of the superimposed color toner image is formed on the photoreceptor drum 10.

Next, the obverse image formed on the photoreceptor drum 10 is synchronized with the reverse image formed on the toner image receiving body 14*a* in the transfer area, and the toner image receiving body 14*a* is rotated around the axis of the driving roller 14*d* in the direction shown by the dotted-line arrow "b" in FIG. 13, so that it comes into contact with the photoreceptor drum 10.

The recording sheet P, which is a transfer material, is sent from the sheet feed cassette 15, which is a transfer material accommodation means, by the feed roller 15*a*, and fed and conveyed to the timing roller 15*c* by the sheet feed roller 15*b*.

The recording sheet P is sent to the transfer area 14*b* by the timing roller 15*c* in synchronization with the color toner image as the obverse image carried on the photoreceptor drum 10, and the color toner image as the reverse image carried on the toner image receiving body 14*a*. In this case, the recording sheet P is paper-charged to the same polarity as the toner by a paper charger 14*f*, is attracted to the toner image receiving body 14*a*, and is sent to the transfer area 14*b*. By paper-charging the recording sheet P to the same polarity as the toner, it prevents the recording sheet P from being attracted to each other by the toner image on the toner image receiving body, or the toner image on the image carrier, so that the toner image is not disturbed.

The obverse image on the peripheral surface of the photoreceptor drum 10 is collectively transferred onto the upper surface side of the recording sheet P by the transfer device which applies voltage with a reverse polarity as the toner 14*c* (in the present example, positive polarity) (the first transfer means). In this case, the reverse image on the peripheral surface of the toner image receiving body 14*a* is not transferred onto the recording sheet P, and exists on the toner image receiving body 14*a*. Next, the reverse image on the peripheral surface on the toner image receiving body 14*a* is collectively transferred onto the lower surface side of the recording sheet P, by a reverse surface transfer device 14*g* which has applied the voltage with the reverse polarity as the toner (in the present example, positive polarity) (the second transfer means).

Because a toner image for each color is superimposed on previous ones, it is preferable for the collective transfer, that the upper layer and the lower layer of the toner layer are charged by the same charging amount and with the same polarity. For this reason, the double-surface image formation, in which the polarity of the color toner image formed on the toner image receiving body 14*a* is reversed by corona charging, or in which the polarity of the color toner image formed on the image carrier is reversed by corona charging, is not preferable because the lower layer toner is not sufficiently charged with the same polarity, resulting in inadequate transfer.

It is preferable for an increase of the transfer property of the reversal image formation that the reversal development is repeated on the image carrier; the color toner image with the same polarity formed by superimposition, is collectively transferred onto the toner image receiving body 14*a* while the polarity is not changed; and next, it is collectively transferred onto the recording sheet P while the polarity is not changed. For the obverse image formation also, it is preferable that the reversal development is repeated on the image carrier, and the color toner image with the same polarity formed by superimposition, is collectively transferred onto the recording sheet P while the polarity is not changed, for an increase of the transfer property of the obverse image formation.

From the above description, in the color image formation, the double-surface image formation method is preferably adopted in which the color toner image is formed on the obverse surface of the transfer material by operating the first transfer means, and next, the color toner image is formed on the reverse surface of the transfer material by operating the second transfer means, by using the above-described image formation method for the obverse and reverse surfaces.

Toner image receiving body 14*a* is a 0.5–2.0 mm thick endless rubber belt, and is structured in 2 layers of a semi-conductive base body, having resistance value of $10^8$–$10^{12}$ Ω•cm, which is formed of silicon rubber or urethane rubber, and a 5–50 μm thick fluorine coating layer as a toner filming prevention layer, formed on the rubber base body. This layer is also preferably semi-conductive. Instead of a rubber belt base body, 0.1–0.5 mm thick semi-conductive polyester, polystyrene, polyethylene, polyethylene terephthalate, etc., may also be used.

The recording sheet P, on the double-surfaces of which the color toner images have been formed, is discharged by a sheet separation AC discharger 14*h* for transfer material separation, separated from the toner image receiving body 14*a*, and is conveyed to a fixing device 17 as a fixing means, composed of 2 rollers respectively having a heater therein. Adhered toner on the obverse and reverse sides of the recording sheet P is fixed by application of heat and pressure between a fixing roller 17*a* and a pressure roller 17*b*; and the recording sheet P, on both sides of which images have been recorded, is sent by a sheet delivery roller 18 and delivered onto a tray provided outside the apparatus.

The toner image receiving body 14*a* is again rotated around the axis of the driving roller 14*d* in the direction shown by the dotted-line arrow "a" in FIG. 13, and is separated from the photoreceptor drum 10. Toner remaining on the peripheral surface of the toner image receiving body 14*a* after transferring, is removed by a toner image receiving body cleaning device 14*i*. Toner remaining on the peripheral surface of the photoreceptor drum 10 after transferring, is discharged by an image carrier AC discharger 16; then, is moved to the cleaning device 19; scraped off by a cleaning blade 19*a* made of a rubber material being in contact with the photoreceptor drum 10 into the cleaning device 19; and is collected in a waste toner container, not shown, by a screw 19*b*. The photoreceptor drum 10, from the surface of which the remained toner has been removed by the cleaning device 19, is uniformly charged by the scorotron charger 11, and then enters into the next image formation cycle.

The sensor unit 100, which is similar to one described in Example 1, is located downstream of the K developing device 13, positioned at the most downstream position in the rotational direction of the photoreceptor drum 10, in the developing devices 13 of Y, M, C, K, which are a plurality of developing means, and are sequentially arranged in the order of toner image formation, as shown in FIG. 13.

In also the color image forming apparatus in the present invention, in the same manner as described in FIGS. 6–1 and FIG. 5 of Example 1, the processing conditions and the image data processing conditions are set, using the sensor unit 100. The image formation is carried out by employing the processing conditions and the image data processing conditions set above, and then the double-sided image formation in which the image density or color tone is properly adjusted, is carried out.

EXAMPLE 3

Figure 15:
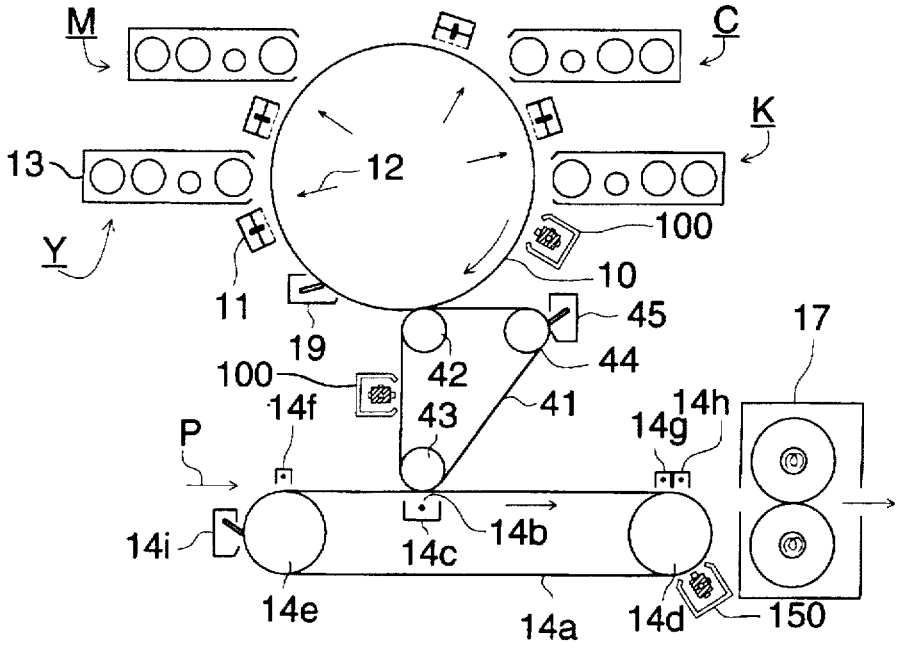
FIG. 15 is a sectional view of the structure of a color image forming apparatus of the third example of the image forming apparatus of the present invention.
Figure 16:
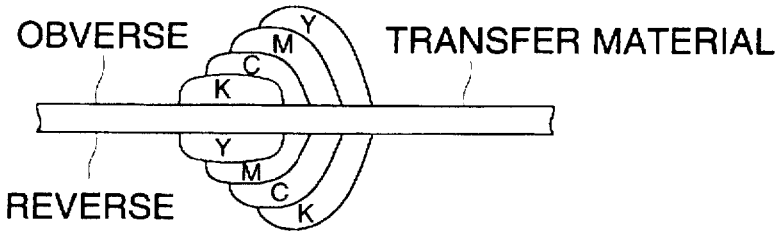
FIG. 16 is a view showing a problem of the color toner image.

Referring to FIG. 15, the image forming process and each mechanism of the third example of the image forming apparatus of the present invention will be described below. FIG. 15 is a sectional structural view of the color image forming apparatus of the third example of the image forming apparatus of the present invention. In the present example, the color toner image is formed on the image carrier by the same image forming process as in Example 1, and the color toner image on the image carrier is transferred onto the toner image receiving body or the transfer material through the intermediate transfer body. Accordingly, the arrangement of the toner image receiving body and the transfer material feeding direction are reverse to those in Example 1. The same numeral is denoted to each member having the same function and structure as those of Example 1.

A transfer belt 41, as an intermediate transfer body, is provided opposite the photoreceptor drum 10, serving as the image carrier. The transfer belt 41 is stretched around the first roller 42 which serves as a transfer roller to press the intermediate transfer belt 41 onto the photoreceptor drum 10, the second roller 43 which serves to press the intermediate transfer belt 41 onto the toner image receiving body 14*a* in the transfer area 14*b*, and a back-up roller 44. Numeral 45 is an intermediate transfer belt cleaning device.

In the same manner as described in Example 1, a superimposed color toner image is formed on the peripheral surface of the photoreceptor drum 10 during a single rotation, by the scorotron charger 11 as a charging means, the exposure unit 12 as an image exposure means, and developing device 13 as a developing means (the toner image forming means).

By the toner image forming processes, a superimposed color toner image as the reverse surface image, is formed on the photoreceptor drum 10, which is the image carrier. After the superimposed color toner image, which is a reverse surface image, on the photoreceptor drum 10, has been temporarily transferred onto an intermediate transfer belt 41 (the first image carrier mean) by the transfer roller 42, it is collectively transferred onto a toner image receiving body 14*a* (the second image carrier means), which is stretched between the driving roller 14*d* and the driven roller 14*e*, and is provided close to the photoreceptor drum 10 or in contact with the drum, by the transfer device 14*c* for applying a voltage having reverse polarity to the toner, (positive polarity in the present example), in the transfer area 14*b*.

The obverse image of the superimposed color toner image is again formed on the photoreceptor drum 10, and is transferred onto the intermediate transfer belt 41. It is necessary to change image data so that the obverse image formed at the time, forms a mirror image with respect to the reverse image on the image carrier.

The recording sheet P, as the transfer material, is sent to the transfer area 14*b*, in synchronization with the color toner image as the obverse image, which has been formed on the photoreceptor drum 10, once transferred on the intermediate transfer belt 41 and is carried thereon, and the color toner image as the reverse image carried on the toner image receiving body 14*a*. In this case, the recording sheet P is paper-charged to the same polarity as the toner by a paper charger 14*f*, is attracted to the toner image receiving body 14*a*, and is sent to the transfer area 14*b*. By paper-charging the recording sheet P to the same polarity as the toner, the recording sheet P is prevented from being attracted by the toner image on the toner image receiving body, or the toner image on the image carrier, so that the toner image remains undisturbed.

The obverse image on the peripheral surface of the photoreceptor drum 10 is collectively transferred onto the upper surface side of the recording sheet P by the transfer device 14*c* which applies voltage with the reverse polarity as the toner (in the present example, positive polarity) (the first transfer means). In this case, the reverse image on the peripheral surface of the toner image receiving body 14*a* is not transferred onto the recording sheet P, and exists on the toner image receiving body 14*a*. Next, the reverse image on the peripheral surface on the toner image receiving body 14*a* is collectively transferred onto the lower surface of the recording sheet P, by a reverse surface transfer device 14*g* which has applied a voltage with the reverse polarity as the toner (in the present example, positive polarity) (the second transfer means).

Toner image receiving body 14*a* is a 0.5–2.0 mm thick endless rubber belt, and is structured of 2 layers of a semiconductive base body, having a resistance value of $10^8$–$10^{12}$ Ω•cm, which is formed of silicon rubber or urethane rubber, and a 5–50 μm thick fluorine coating layer as a toner filming prevention layer, formed outside the rubber base body. This layer is also preferably semi-conductive. Instead of the rubber belt base body, 0.1–0.5 mm thick semi-conductive polyester, polystyrene, polyethylene, polyethylene terephthalate, etc., may also be used.

The recording sheet P, on both surfaces of which the color toner image has been formed, is discharged by a sheet separation AC discharger 14*h* for transfer material separation, separated from the toner image receiving body 14*a*, and is conveyed to a fixing device 17 as a fixing means, composed of 2 rollers respectively having a heater therein. Adhered toner on the obverse and reverse sides of the recording sheet P is fixed by application of heat and pressure between two rollers; the obverse and reverse images are recorded on the recording sheet P, and the sheet P is delivered onto a tray provided outside the apparatus.

Toner remaining on the peripheral surface of the toner image receiving body 14*a* after transferring in the present example, is removed by a blade of a toner image receiving body cleaning device 14*i*, which can be moved into contact with and can be removed from the toner image receiving body 14*a*.

The sensor unit 100, which is similar to one described in Example 1, is located downstream of the K developing device 13, positioned at the most downstream position in the rotational direction of the photoreceptor drum 10, in the Y, M, C, K developing devices 13, which are a plurality of developing means, and sequentially arranged in the order of toner image formation, as shown in FIG. 13.

Also in the color image forming apparatus in the present invention, in the same manner as described in FIGS. 6–12 and FIG. 5 of Example 1, the processing conditions and the image data processing conditions are set by using the sensor unit 100. Image formation is carried out by using the processing conditions and the image data processing conditions set above. Thereby, the double-sided image formation in which the image density or color tone is properly adjusted, is carried out.

Although the present invention was described using the color image forming apparatus, it can, of course, be also applied for a monochromatic image forming apparatus. Further, the present invention is not limited to the above-described system, but also includes variations by which double-sided images are formed. For example, the method in which processing conditions and image data processing conditions are changed with respect to the obverse surface and the reverse surface, as described above, can also be applied to the method, disclosed in Japanese Patent Publication No. 28740/1979, in which, relating to the reverse image, after the polarity of toner has been reversed, images are simultaneously transferred onto both surfaces of the transfer material, and also for the tandem method, disclosed in Japanese Patent Publication Open to Public Inspection Nos. 180969/1988, 298255/1988, 44457/1989, etc., so that the double-sided image formation in which the image density and the color tone are properly adjusted, can be carried out.

According to the present invention, double-sided image formation in which the image density and the color tone are properly adjusted, can be conducted.

According to the present invention, the double-sided image formation in which the image density is more properly adjusted, can be conducted.

According to the present invention, the double-sided image formation in which the color tone is more properly adjusted, can be conducted.

What is claimed is:

1. An apparatus for forming an image on a sheet material, comprising:

a first image carrier;

a toner image forming unit for forming a first toner image and a second toner image separately on the first image carrier;

a second image carrier on which the second toner image is transferred at a time from the first image carrier;

a first transfer device for transferring the first toner image from the first image carrier to one side of the sheet material;

a second transfer device for transferring the second toner image from the second image carrier to an other side of the sheet material; and a fixing unit for fixing the first toner image onto the one side of the sheet material and for fixing the second toner image onto the other side of the sheet material;

wherein the toner image forming unit chances an image forming condition when the second toner image is formed so as to be different from that when the first toner image is formed.

2. The apparatus of claim 1, wherein the toner image forming unit comprises:

a charging unit for charging the first image carrier;

an exposure unit for imagewise exposing the charged first image carrier so as to form a latent image; and a developing unit for developing the latent image so as to form a toner image on the first image carrier.

3. The apparatus of claim 2, wherein the charging unit, the exposure unit and the developing unit are controlled to repeat the charging, the imagewise exposing and the developing so that plural toner images differing in color are formed on the first image carrier.

4. An apparatus for forming an image on a sheet material, comprising:

a first image carrier;

an image forming unit for forming a first toner image and a second toner image separately on the first image carrier, the image forming unit comprising:

a charging unit for charging the first image carrier;

an exposure unit for imagewise exposing the charged first image carrier so as to form a latent image; and a developing unit for developing the latent image so as to form a toner image on the first image carrier;

a second image carrier on which the second toner image is transferred at a time from the first image carrier;

a first transfer device for transferring the first toner image from the first image carrier to one side of the sheet material;

a second transfer device for transferring the second toner image from the second image carrier to an other side of the sheet material; and a fixing unit for fixing the first toner image onto the one side of the sheet material and for fixing the second toner image onto the other side of the sheet material;

wherein at least one process condition of the charging unit, the exposing unit, and the developing unit, when the second toner image is formed, is changed so as to be different from that when the first toner image is formed.

5. The apparatus of claim 4, wherein the at least one process condition is changed so that a toner amount of the second toner image on the first image carrier which is transferred from the first image carrier to the second image carrier is increased more than the first toner image on the first image carrier.

6. The apparatus of claim 4, further comprising:

at least one of a first sensor located so as to face the first image carrier, and a second sensor located so as to face the second image carrier, wherein a toner image pattern is formed on the first image carrier or the second image carrier, a density of the toner image pattern on the first image carrier is measured by the first sensor and a density of the toner image pattern on the second image carrier is measured by the second sensor, and a process condition for the first image or the second image is adjusted based on the density measured by the first sensor or the second sensor.

7. The apparatus of claim 4, wherein:

when the first and second toner images are formed, a process condition is changed based on correction data previously memorized.

8. The apparatus of claim 4, wherein the charging unit, the exposure unit and the developing unit are controlled to repeat the charging, the imagewise exposing and the developing so that plural toner images differing in color are formed on the first image carrier.

9. The apparatus of claim 8, wherein plural sets of the charging unit, the exposure unit and the developing unit, corresponding in number to plural color toner images differing in colors are provided around the first image carrier, and the plural color toner images are superimposed during a single rotation of the first image carrier.

10. The apparatus of claim 8, wherein a single exposure unit is provided, and forms latent images corresponding to the plural color toner images during plural rotations of the first image carrier.

11. An apparatus for forming an image on a sheet material, comprising:

a first image carrier;

a toner image forming unit for forming a first toner image and a second toner image separately on the first image carrier, wherein the toner image forming unit comprises a image data processing unit for processing image data and forms the first and second toner images based on the processed image data;

a second image carrier on which the second toner image is transferred at a time from the first image carrier;

a first transfer device for transferring the first toner image from the first image carrier to one side of the sheet material;

a second transfer device for transferring the second toner image from the second image carrier to an other side of the sheet material; and a fixing unit for fixing the first toner image onto the one side of the sheet material and for fixing the second toner onto the other side of the sheet material;

wherein the image data processing unit changes an image processing condition when the second toner image is formed so as to be different from that when the first toner image is formed.

12. The apparatus of claim 11, wherein:

the image processing condition to be changed is one of a data processing condition for γ-correction and a data process condition for color correction.

13. The apparatus of claim 11, wherein the toner image forming unit comprises:

a charging unit for charging the first image carrier;

an exposure unit for imagewise exposing the charged first image carrier so as to form a latent image; and a developing unit for developing the latent image so as to form a toner image on the first image carrier.

14. The apparatus of claim 13, wherein the charging unit, the exposure unit and the developing unit are controlled to repeat the charging, the imagewise exposing and the developing so that plural toner images differing in color are formed on the first image carrier.

15. The apparatus of claim 14, wherein the image data processing unit comprises a masking device for conducting a color correction.

16. The apparatus of claim 15, wherein the masking device corrects image data of each color in accordance with a superimposing order of the plural color toner images superimposed on a sheet member.

17. The apparatus of claim 15, wherein the color correction includes a UCR (Under Color Removal) treatment.

18. The apparatus of claim 13, wherein plural sets of the charging unit, the exposure unit and the developing unit, corresponding in number to plural color toner images differing in colors are provided around the first image carrier, and the plural color toner images are superimposed during a single rotation of the first image carrier.

19. The apparatus of claim 13, wherein a single exposure unit is provided, and forms latent images corresponding to plural color toner images during plural rotations of the first image carrier.

* * * * *